US010730323B2

(12) United States Patent
Harigae et al.

(10) Patent No.: US 10,730,323 B2
(45) Date of Patent: Aug. 4, 2020

(54) PRINTING APPARATUS, CONTROL METHOD, AND NON-TRANSITORY STORAGE MEDIUM

(71) Applicant: CANON KABUSHIKI KAISHA, Tokyo (JP)

(72) Inventors: Ryo Harigae, Inagi (JP); Yoshiaki Suzuki, Nagareyama (JP); Itaru Wada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/912,284

(22) Filed: Mar. 5, 2018

(65) Prior Publication Data

US 2018/0257406 A1 Sep. 13, 2018

(30) Foreign Application Priority Data

Mar. 10, 2017 (JP) ..... 2017-046421
Mar. 10, 2017 (JP) ..... 2017-046422
(Continued)

(51) Int. Cl.
*B65H 23/34* (2006.01)
*B41J 15/04* (2006.01)
(Continued)

(52) U.S. Cl.
CPC ..... *B41J 15/04* (2013.01); *B41J 3/60* (2013.01); *B41J 11/0005* (2013.01); *B41J 11/42* (2013.01);
(Continued)

(58) Field of Classification Search
CPC ..... B41J 3/60; B41J 15/04; B41J 15/16; B41J 15/18; B65H 16/10; B65H 16/103;
(Continued)

(56) References Cited

U.S. PATENT DOCUMENTS 9,242,486 B2 * 1/2016 Verhofstad ..... B41J 3/60
2011/0135372 A1 * 6/2011 Sato ..... B41J 3/60 400/614
2015/0273893 A1 * 10/2015 Kudo ..... B41J 11/663 347/16

FOREIGN PATENT DOCUMENTS

CN 1220630 A 6/1999
CN 102729646 A 10/2012
(Continued)

*Primary Examiner* — Luis A Gonzalez
(74) *Attorney, Agent, or Firm* — Canon U.S.A., Inc. I.P. Division

(57) ABSTRACT

A printing apparatus includes first and second supplying portions, a printer, and a winding unit. The first supplying portion can supply a recording medium on a conveyance route to the printer for first surface printing. The winding unit then rotates in a first direction to wind the printed recording medium. A wound recording medium edge is located at a specific location and then guided to a conveyance route opening portion if the wind direction is a second direction. After the edge is at the specific location, the recording medium is supplied through the opening portion to the printer for second surface printing. If the second supplying portion supplies the recording medium for first surface printing, then it supplies the medium for second surface printing. If a user sets a wound-in-advance recording medium to the second supplying portion, the second supplying portion supplies the set recording medium to the printer.

34 Claims, 23 Drawing Sheets

(30) Foreign Application Priority Data

Mar. 10, 2017 (JP) ..... 2017-046423
Mar. 10, 2017 (JP) ..... 2017-046424

(51) Int. Cl.

| | |
|---|---|
| ***B41J 15/16*** | (2006.01) |
| ***B65H 16/10*** | (2006.01) |
| ***B65H 23/192*** | (2006.01) |
| ***B41J 11/42*** | (2006.01) |
| ***B41J 3/60*** | (2006.01) |
| ***B41J 11/00*** | (2006.01) |
| ***B41J 15/18*** | (2006.01) |

(52) U.S. Cl.
CPC ..... *B41J 15/16* (2013.01); *B41J 15/18* (2013.01); *B65H 23/192* (2013.01); *B65H 23/34* (2013.01); *B65H 2404/143* (2013.01)

(58) Field of Classification Search
CPC ..... B65H 16/106; B65H 20/36; B65H 20/38; B65H 20/005; B65H 23/34; B65H 23/192; B65H 23/185; G03G 15/6517; G03G 15/652
See application file for complete search history.

(56) References Cited

FOREIGN PATENT DOCUMENTS

| | | | | |
|---|---|---|---|---|
| CN | 104339873 | A | | 2/2015 |
| CN | 105667091 | A | | 6/2016 |
| JP | 09267957 | A | * | 10/1997 |
| JP | 2008-126530 | A | | 6/2008 |

* cited by examiner

PRINTING APPARATUS, CONTROL METHOD, AND NON-TRANSITORY STORAGE MEDIUM

BACKGROUND OF THE INVENTION

Field of the Invention

The present disclosure relates to a printing apparatus, a control method, and a non-transitory storage medium.

Description of the Related Art

A known printing apparatus performs duplex printing in a manner in which a sheet the front surface of which is printed by a printing portion is wound and the wound sheet is supplied again to the printing portion to print the back surface of the sheet. Japanese Patent Laid-Open No. 2008-126530 discloses an apparatus including two sheet-supplying portions each of which can supply a sheet pulled out of a roll. During duplex printing performed by the apparatus in Japanese Patent Laid-Open No. 2008-126530, a sheet the front surface of which is printed after being pulled out of one of the sheet-supplying portions is wound around the other sheet-supplying portion, and subsequently, the wound sheet is supplied again to the printing portion to print the back surface of the sheet.

Apparatuses that can perform duplex printing are in widespread use, and there is a need to improve the operability of the apparatuses that can perform duplex printing.

SUMMARY OF THE INVENTION

The present disclosure works towards improving the operability of an apparatus that can perform duplex printing. In an example, a printing apparatus includes a supply unit that supplies a recording medium wound around a paper tube to a printing portion and that does not accept a user operation on the recording medium to supply the recording medium wound around the paper tube to the printing portion after the recording medium is wound around the paper tube, and a second print unit that causes the printing portion to print a second surface of the recording medium supplied from a second supplying portion to the printing portion after the recording medium is wound around the paper tube.

According to an aspect of the present invention, a printing apparatus includes a printing portion configured to print to a first surface of a recording medium and a second surface of the recording medium opposite the first surface, a first supplying portion configured to supply the recording medium to the printing portion, a second supplying portion configured to supply the recording medium to the printing portion and that differs from the first supplying portion, a first print unit configured to print, by the printing portion, to the first surface of the recording medium supplied from the first supplying portion, a winding unit configured to wind the recording medium, supplied from the first supplying portion and having the printed first surface, around a winding member set in the second supplying portion by rotating the winding member in a first direction, a control unit configured to control a position of an edge of the recording medium wound around the winding member such that the edge is located at a specific location, wherein, in a case where the winding member is rotated in a second direction opposite the first direction, the edge is guided from the specific location to an opening portion of a conveyance route on which the recording medium wound around the winding member passes when the recording medium is supplied to the printing portion, a supply unit configured to supply the recording medium wound around the winding member to the printing portion through the opening portion by rotating the winding member in the second direction after the edge is controlled to be located at the specific location, and a second print unit configured to print, by the printing portion, to the second surface of the recording medium supplied from the second supplying portion to the printing portion after the recording medium is wound around the winding member, wherein, in a case where the recording medium supplied by the second supplying portion and having the printed first surface is wound around the winding member, the second supplying portion supplies the wound recording medium to the printing portion, and wherein, in a case where a recording medium that is wound in advance is set to the second supplying portion by a user, the second supplying portion supplies the set recording medium to the printing portion.

Further features of the present invention will become apparent from the following description of exemplary embodiments with reference to the attached drawings.

DESCRIPTION OF THE EMBODIMENTS

Embodiments will hereinafter be described in detail with reference to the drawings. The embodiments do not limit the recited in claims. All of combinations of features described according to the embodiments are not necessarily essential to solutions.

First Embodiment

A printing apparatus according to a first embodiment will be described. According to the present embodiment, an inkjet printer is described as an example of the printing apparatus. The printing apparatus may be a multifunction peripheral (MFP) having functions other than a print function such as the function of a scanner, a copying machine, or a fax machine, or may be a single function peripheral (SFP) having a print function. The print system used in the printing apparatus is not limited to an inkjet system and may be, for example, an electrophotographic system. The print described herein means a process of forming an image on a recording medium such as paper by using a recording material such as ink.

The printing apparatus according to the present embodiment includes sheet-supplying devices each of which supplies a roll sheet (sheet) as the recording medium, and a printing portion that forms (prints) an image on the sheet by using the recording material.

Figure 8:
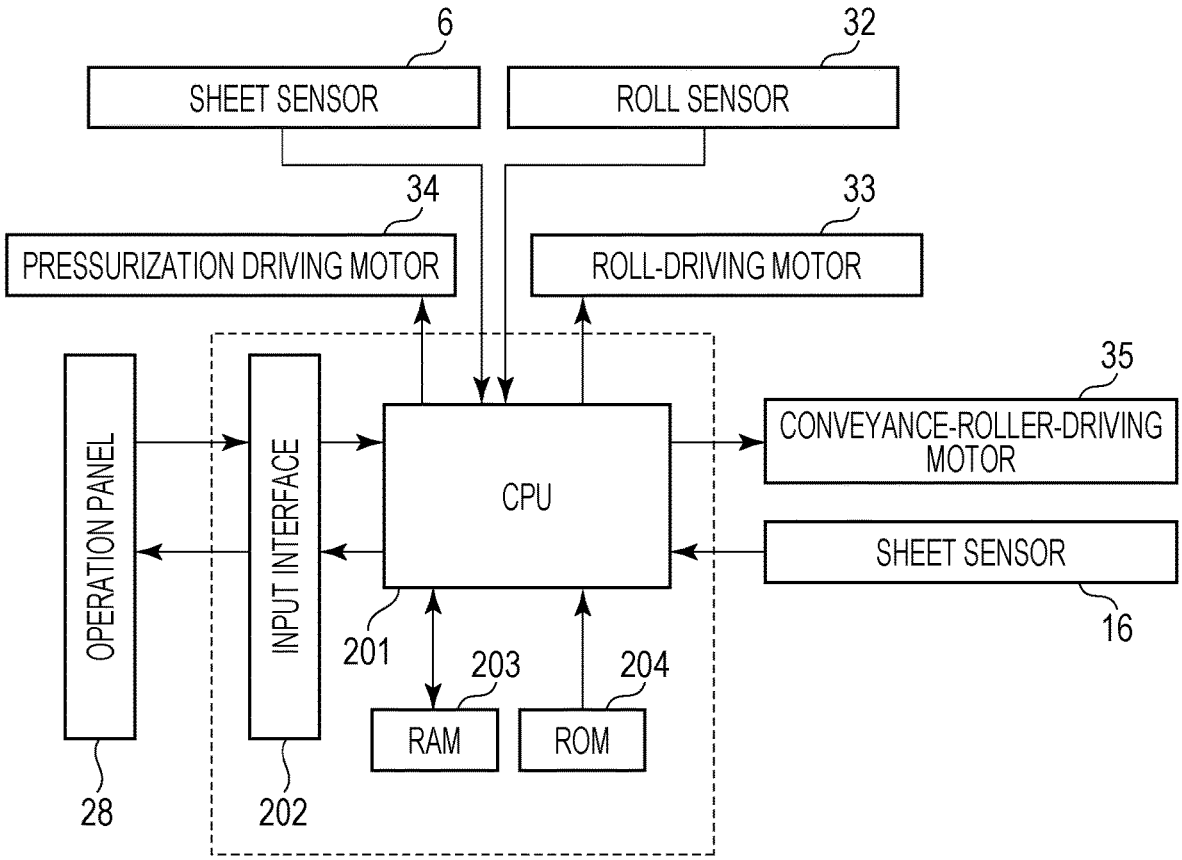
FIG. 8 is a block diagram illustrating an example of the structure of a control system that the printing apparatus includes.

FIG. 8 is a block diagram illustrating an example of the structure of a control system that a printing apparatus 100 includes. A CPU 201 controls components of the printing apparatus 100 including sheet-supplying devices 200, a sheet-conveying portion 300, and a printing portion 400, described later, in accordance with control programs stored in a ROM 204. Information about various configurations based on user operations on an operation panel 28 is inputted in the CPU 201 via an input interface 202, and the CPU 201 stores the inputted information in a RAM 203. The CPU 201 appropriately reads the information stored in the RAM 203 and uses the read information for various processes.

Sheet sensors 6 (detecting portions) and a sheet sensor 16 detect the front edge of the sheet, roll sensors 32 detect whether spool members 2 are set at positions at which the spool members 2 are to be set, and the results of detection are inputted in the CPU 201. The results of detection mean information that each object has been detected. The fact that the results of detection are inputted from the sheet sensors 6 and the roll sensors 32 represents that automatic supply of the sheet to the printing portion 400 is ready. Accordingly, in the case where the results of detection are inputted, the CPU 201 causes one of pressurization driving motors 34 to rotate to adjust a pressing force against a corresponding one of arm members 4. Subsequently, the CPU 201 causes one of roll-driving motors 33 to rotate to impart forward rotation to a corresponding one of roll sheets R in the direction of an arrow C1, and a sheet 1 is fed to the sheet-conveying portion 300. At this time, driven rotating bodies (pressure contact members) 8 and 9 included in the arm member 4 are in contact with the side surface of the roll sheet R from below and reduce the occurrence of slack and distortion of the sheet 1, and the sheet 1 is fed straight. According to the present embodiment, the driven rotating bodies 8 and 9 are not directly rotated by, for example, a motor but are rotated together with rotation of the roll sheet R with the rotation of the roll sheet R transmitted thereto.

According to the present embodiment, a route on which the sheet 1 is conveyed and passes during one-side printing or duplex printing is referred to as a conveyance route.

The roll-driving motors 33 are motors for forward rotation and backward rotation of the roll sheets R and form driving mechanisms (rotation mechanisms) that can rotate the roll sheets R. The pressurization driving motors 34 are motors that rotate rotation cams 3*a* to adjust the pressing force against the arm members 4. A conveyance-roller-driving motor 35 is a motor for forward rotation and backward rotation of a conveyance roller 14.

Figure 1:
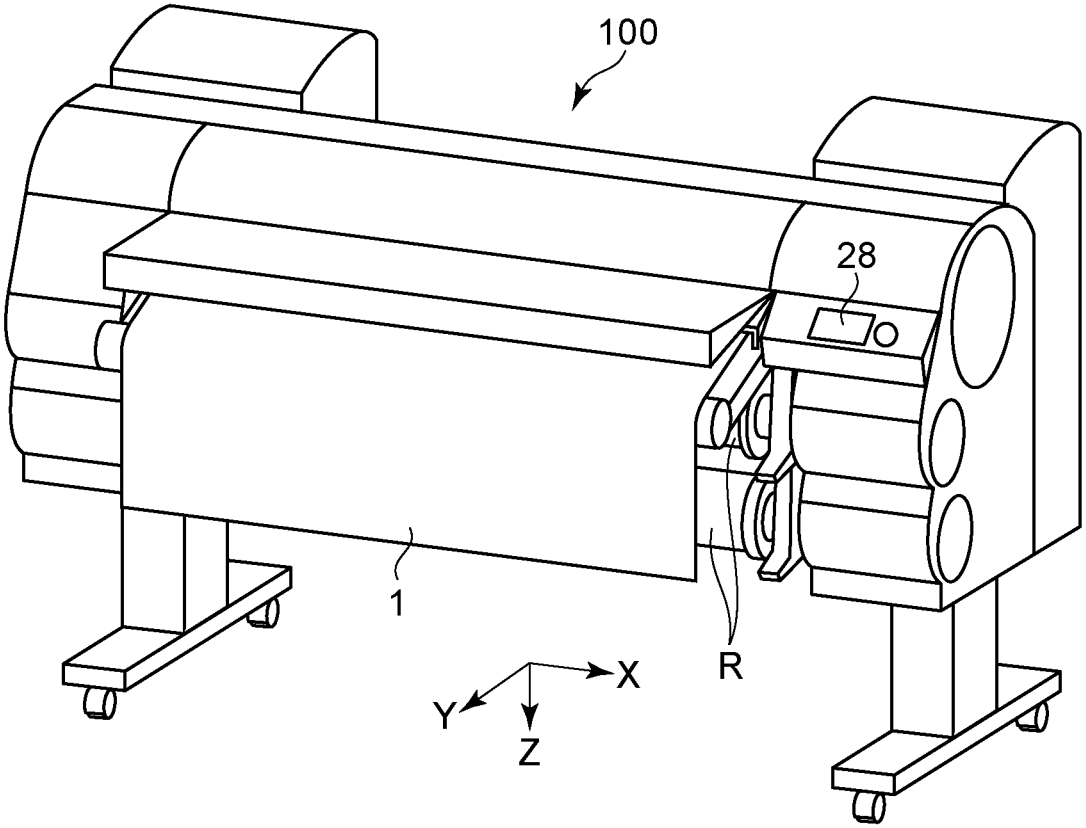
FIG. 1 is a perspective view of a printing apparatus.

As illustrated in FIG. 1, the printing apparatus 100 can hold two roll sheets R, each of which is obtained by winding the sheet 1 around a roll core (paper tube) into a roll shape, by using a corresponding one of two sheet-supplying devices 200. An image is printed on the sheet 1 pulled out of one of the roll sheets R that is selected. The number of the sheet-supplying devices 200 that the printing apparatus 100 includes is not limited to two and may be one, or three or more. According to the present embodiment, the sheet-supplying devices 200 can be used as supplying units or as winding units but may be used as the supplying units only. The printing apparatus 100 may include a unit that can be used as the winding unit only.

The operation panel 28 is an interface module that accepts various operations from a user. A user can use various switches included in the operation panel 28 for various configurations of the printing apparatus 100. Examples of the various configurations of the printing apparatus 100 include a configuration for registering the size and kind of the sheet 1, a configuration for representing whether the printing apparatus 100 is made online, and a configuration for switching operation modes described later.

Figure 2:
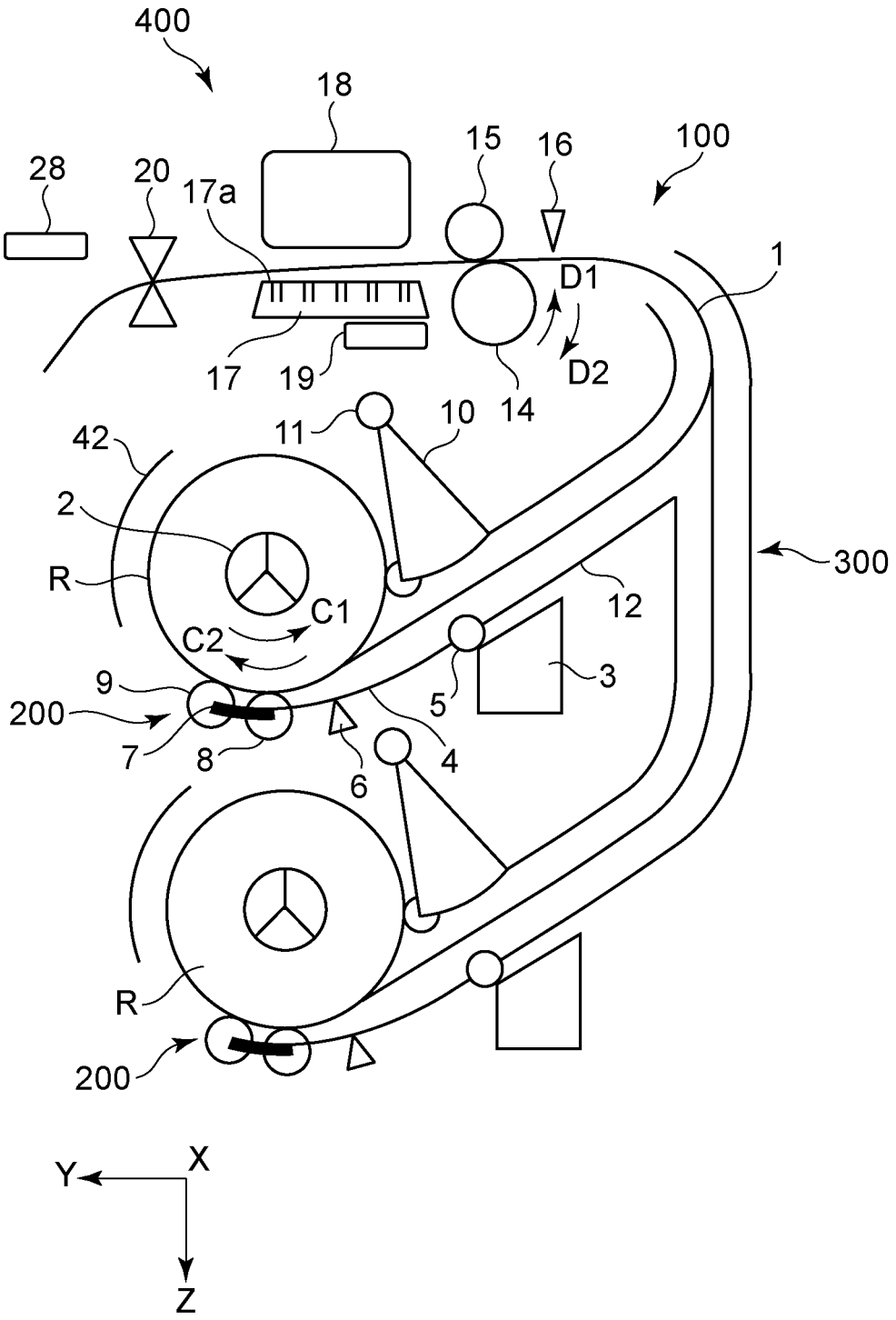
FIG. 2 is a schematic sectional view of a main part of the printing apparatus.

FIG. 2 is a schematic sectional view of a main part of the printing apparatus 100. The two sheet-supplying devices 200 that can supply the respective roll sheets R are disposed in the printing apparatus 100. The sheet 1 pulled out of each roll sheet R by using the corresponding sheet-supplying device 200 is conveyed to the printing portion 400, which is a module for printing, by using the sheet-conveying portion (conveyance mechanism) 300. The printing portion 400 forms an image on the sheet 1 on a platen 17 located opposite a printing head 18 in a manner in which the printing head 18 for inkjet printing discharges ink. The printing head 18 discharges the ink from a discharge port by using a discharge-energy-generating element such as a thermoelectric conversion element (heater) or a piezoelectric element. In the case where the printing head 18 uses the thermoelectric conversion element, the printing head 18 uses a bubble generating energy, which is created when heat generated by the printing head 18 causes the ink to bubble, to enable the ink to be discharged from the discharge port.

The recording system used in the printing head 18 is not limited to the inkjet system as described above. According to the present embodiment, the printing method of the printing portion 400 is a serial scan method. The printing method, however, is not limited thereto and may be, for example, a full-line method. In the case of using the serial scan method, the printing portion 400 conveys the sheet 1 on the conveyance route a predetermined distance, and subsequently scans the printing head 18 in the direction intersecting the conveyance direction of the sheet 1 to form the image on the sheet 1. The printing portion 400 repeatedly conveys the sheet 1 on the conveyance route the predetermined distance and scans the printing head 18 to form the image. In the case of the full-line method, the printing portion 400 secures the printing head 18 that is elongated and that extends in the direction intersecting the conveyance direction of the sheet 1 on the conveyance route, and causes the printing head 18 to discharge the ink while the sheet 1 is continuously conveyed to form the image. The sheet 1 on which the image is formed continues to be conveyed, passes through a sheet outlet, and hangs down by own weight.

Each spool member 2 in a shaft shape is inserted in a hollow portion of the corresponding roll sheet R. The spool member 2 is rotated in the directions of arrows C1 and C2 by the corresponding roll-driving motor described later. Thus, the roll sheet R rotates in the directions of the arrows C1 and C2 with the center thereof held. The direction of C1 is opposite to the conveyance direction of the sheet 1 at a print position facing the printing head 18. The direction of C2 is the same direction as the conveyance direction of the sheet 1 at the print position facing the printing head 18. Each sheet-supplying device 200 includes a driving portion 3, the arm member (movable body) 4, an arm rotating shaft 5, the first sheet sensor 6, a swing member 7, the driven rotating bodies (pressure contact members) 8 and 9, a separation flapper (upper guide body) 10, and a flapper rotating shaft 11, as described later.

Conveyance guides 12 form routes on which the sheets 1 pulled out of the respective sheet-supplying devices 200 are guided to the printing portion 400. Each conveyance guide 12 guides the lower surface of the sheet 1, and each separation flapper 10 guides the upper surface of the sheet 1. Consequently, the conveyance guide 12 and the separation flapper 10 form an opening portion of each route on which the sheet 1 is guided to the printing portion 400. Each opening portion is located on the lower side in the gravity direction than the center of the paper tube set in the corresponding sheet-supplying device 200. The conveyance roller 14 is rotated in the directions of arrows D1 and D2 by the conveyance-roller-driving motor described later. A nip roller 15 is rotated with rotation of the conveyance roller 14 in a close contact state in which the nip roller 15 is in close contact with the conveyance roller 14. A nip-roller separation motor, not illustrated, switches the state of the nip roller 15 between the close contact state and a separation state in which the nip roller 15 is separated from the conveyance roller. The nip roller 15 adjusts a nipping force against the sheet nipped between the conveyance roller 14 and the nip roller 15. The conveyance roller 14 rotates when the second sheet sensor 16 detects the front edge of the sheet 1. The speed of the sheet 1 conveyed by using the conveyance roller 14 is higher than the speed of the sheet 1 pulled when each roll sheet R rotates, and a back tension is applied to the sheet 1. This prevents the occurrence of slack of the sheet 1 and reduces the occurrence of a crease of the sheet 1 and a conveyance error.

The platen 17 of the printing portion 400 attracts the back surface of the sheet 1 by using a negative pressure produced by a suction fan 19 through suction holes 17*a*. Thus, the position of the sheet 1 is restricted, and the sheet 1 is conveyed along the platen 17. Accordingly, the sheet 1 does not rise above the platen 17, and precise print of the printing head 18 can be achieved. A cutter 20 (cutting portion) cuts the sheet 1 along the rear edge of a region of the sheet 1 in which the image is formed. In the case where the print has a margin, the sheet 1 is cut along locations the margin away backward from the rear edge of the region of the sheet 1 in which the image is formed.

The printing apparatus 100 has predetermined configurations such as a distance from the printing head 18 to the cutter 20 and a conveyance distance until the rear edge of the region in which the image is formed reaches the position of the cutter 20 after the printing head 18 forms the image. The sheet 1 on which the image is formed falls down the cutter 20 by being cut. A cover 42 of each roll sheet R prevents the falling sheet 1 from returning again to the corresponding sheet-supplying device 200. These operations of the printing apparatus 100 are controlled by the CPU 201.

Figure 3A:
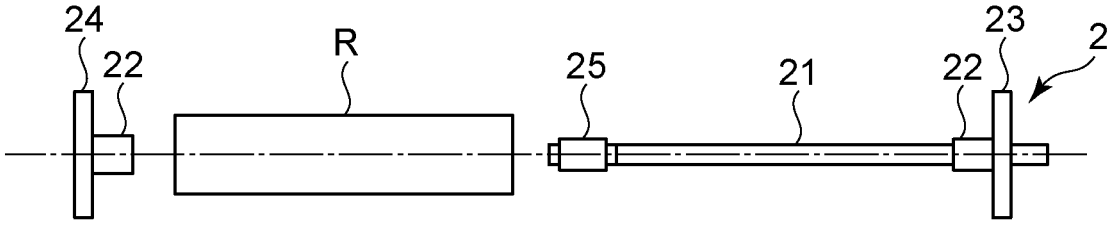
FIGS. 3A to 3C illustrate a procedure for setting a roll sheet in one of sheet-supplying devices by using a spool member.
Figure 3B:
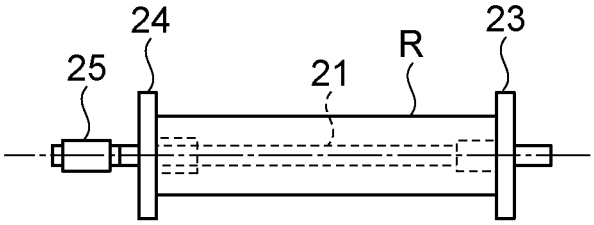
Figure 3C:
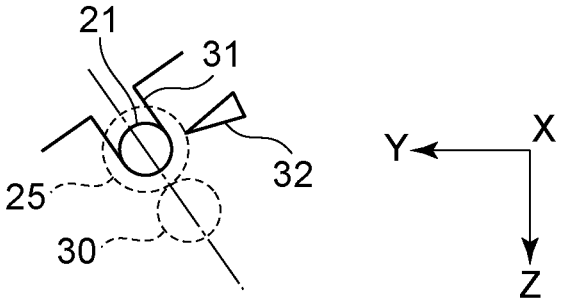

FIGS. 3A, 3B, and 3C illustrate a procedure for setting each roll sheet R in the corresponding sheet-supplying device 200 by using the corresponding spool member 2. Each spool member 2 includes a spool shaft 21, friction members 22, a reference spool flange 23, a non-reference spool flange 24, and a spool gear 25. The reference spool flange 23 is mounted on an end of the spool shaft 21, and the spool gear 25 that rotates the spool shaft 21 is mounted on the other end. The reference spool flange 23 and the non-reference spool flange 24 include the respective friction members 22.

When the roll sheet R is set on the spool member 2, the non-reference spool flange 24 engaged with the spool shaft 21 is first disengaged therefrom, and the spool shaft 21 is inserted into the hollow portion of the roll sheet R. The outer diameter of the spool shaft 21 is smaller than the inner diameter of the hollow portion of the roll sheet R. Thus, a space is formed between the spool shaft 21 and the roll sheet R even when the spool shaft 21 is inserted into the hollow portion of the roll sheet R, and accordingly, a user can insert the spool shaft 21 into the hollow portion of the roll sheet R with a weak force. When the spool shaft 21 is inserted into the hollow portion of the roll sheet R, a right-hand-side bottom portion of the roll sheet R in FIG. 3A comes into contact with the reference spool flange 23. At this time, the friction member 22 included in the reference spool flange 23 is fitted into the hollow portion of the roll sheet R. Thus, the friction member 22 and the roll sheet R come into contact with each other, the space formed between the spool shaft 21 and the roll sheet R is eliminated, and the spool shaft 21 and the roll sheet R can be secured to each other. Subsequently, the non-reference spool flange 24 is engaged with the spool shaft 21, and the friction member 22 inside the non-reference spool flange 24 is fitted into the hollow portion of the roll sheet R. Thus, the reference spool flange 23 and the non-reference spool flange 24 can secure the roll sheet R and inhibit the roll sheet R from moving in the left-right direction on the spool shaft 21.

Thus, the roll sheet R is set on the spool member 2. FIG. 3B illustrates the spool member 2 on which the roll sheet R is set. Subsequently, both ends of the spool member 2 on which the roll sheet R is thus set are fitted into spool holders 31 of one of the sheet-supplying devices 200, and the roll sheet R has been set. FIG. 3C is a side view of the spool member 2 both ends of which are fitted into the spool holders 31.

In the case where a paper tube 27 is set on one of the spool members 2 to wind the sheet 1, the above processes are performed by using the paper tube 27 instead of the roll sheet R.

The spool holders 31 are formed in each sheet-supplying device 200 at positions corresponding to both ends of the spool shaft 21. The inner surface of each spool holder 31 has a U-shape. A user can fit the ends of the spool shaft 21 from opening portions thereof. The spool gear 25 is connected to the roll-driving motor described later with a drive gear 30 of the sheet-supplying device 200 interposed therebetween in a state where the spool member 2 is fitted in the spool holders 31. The roll-driving motor imparts forward rotation and backward rotation to the spool member 2 and the roll sheet R, and this enables supply and winding of the sheet 1. Each roll sensor 32 detects the presence or absence of the corresponding spool member 2. That is, the roll sensor 32 detects whether the spool member 2 is set at a position at which the spool member 2 is to be set in the corresponding sheet-supplying device 200.

Description of Structure for Sheet Supply

Figure 4:
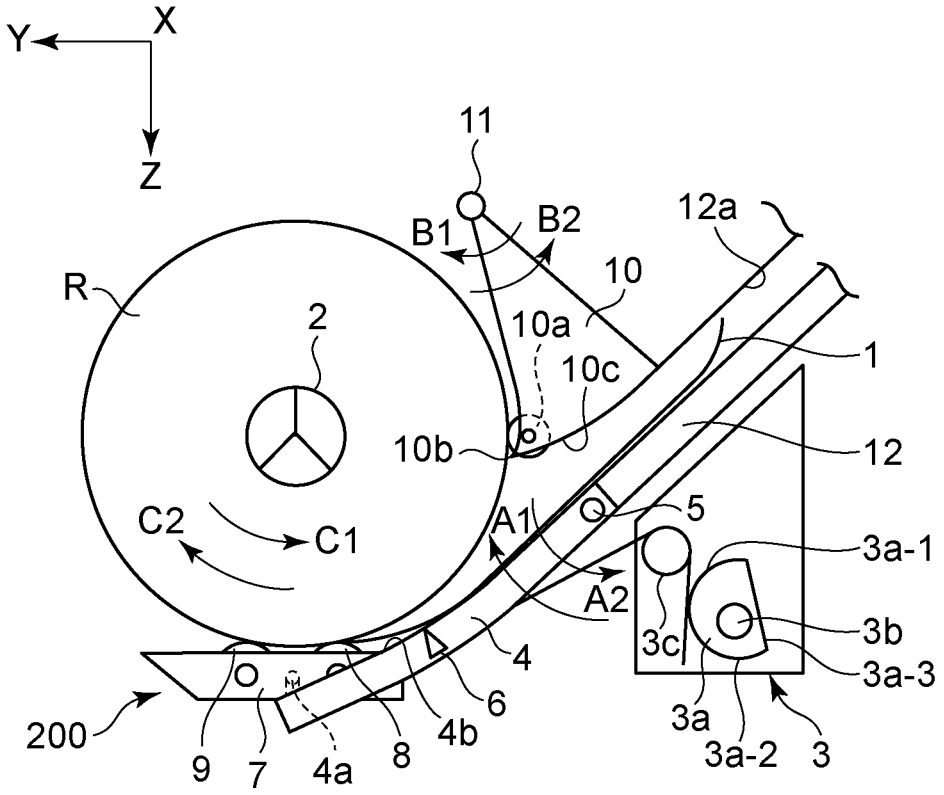
FIG. 4 is a sectional view of the sheet-supplying device in which a roll sheet R set on the spool member is set.

FIG. 4 is a sectional view of one of the sheet-supplying devices 200 with the roll sheet R that is set on the spool member 2 in the above manner set. The sheet 1 is pulled out of the roll sheet R set in the sheet-supplying device 200, passes through the opening portion of the corresponding route, on which the sheet 1 is guided to the printing portion 400, formed by the separation flapper 10 and the conveyance guide 12 described later, and is guided to the printing portion 400. According to the present embodiment, the two sheet-supplying devices 200 have the same structure.

Conventionally, a user manually pulls the sheet 1 out of the roll sheet R set in each sheet-supplying device 200 to guide the sheet 1 to the corresponding opening portion. Specifically, a user conventionally finds the front edge of the sheet 1 of the roll sheet R and manually inserts the front edge found into the opening portion. According to the present embodiment, each sheet-supplying device 200 automatically guides the sheet 1 to the corresponding opening portion, and a user can omit the manual operation. This will now be described. The function of the sheet-supplying device 200 to automatically guide the sheet 1 to the opening portion is referred to as an automatic sheet-supplying function.

The arm member (movable body) 4 is mounted on the conveyance guide 12 by using the arm rotating shaft 5 so as to be rotatable in the directions of arrows A1 and A2. A guide portion 4*b* (lower guide body) that guides the lower surface of the sheet 1 pulled out of the roll sheet R is formed on an upper portion of the arm member 4. A torsion coil spring 3*c* that presses the arm member 4 in the direction of the arrow A1 is interposed between the arm member 4 and the rotation cam 3*a* of the driving portion 3. The pressurization driving motor 34 rotates the rotation cam 3*a*, and a pressing force of the torsion coil spring 3*c* against the arm member 4 in the direction of the arrow A1 changes accordingly. When a portion 3*a*-1 of the rotation cam 3*a* that has a relatively large diameter comes into contact with the torsion coil spring 3*c*, the pressing force increases, and a "strong nip pressing force" described later is produced. When a portion 3*a*-2 of the rotation cam 3*a* that has a relatively small diameter comes into contact with the torsion coil spring 3*c*, the pressing force decreases, and a "weak nip pressing force" described later is produced. When a flat portion 3*a*-3 of the rotation cam 3*a* comes into contact with the torsion coil spring 3*c*, the pressing force to press the arm member 4 in the direction of the arrow A1 is canceled, and first and second driven rotating bodies described later are separated from the roll sheet R. That is, the sheet-supplying device 200 can switch three states of a state where the arm member 4 is pressed with the "weak nip pressing force", a state where the arm member 4 is pressed with the "strong nip pressing force", and a state where the pressing force against the arm member 4 is canceled. The states can be switched in a manner in which the CPU 201 controls the drive of the pressurization driving motor 34.

The swing member 7 is mounted on the arm member 4 in a swingable manner. First and second driven rotating bodies (rotating bodies) 8 and 9 are rotatably mounted on the swing member 7 and arranged in the circumferential direction of the roll sheet R. The pressing force against the arm member 4 in the direction of the arrow A1 causes the driven rotating bodies 8 and 9 to come into pressure contact with the outer circumferential portion of the roll sheet R from below the horizontally central axis of the roll sheet R in the gravity direction. The pressure of contact changes in accordance with the pressing force to press the arm member 4 in the direction of the arrow A1. Accordingly, the driving portion 3 functions as a press mechanism that presses the arm member 4. The driving portion 3 also functions as a movement mechanism that moves the arm member 4 such that the driven rotating bodies 8 and 9 are separated from the outer circumferential portion of the roll sheet R.

The separation flapper 10 located above the arm member 4 is mounted on the main body (printer main body) of the printing apparatus 100 so as to be swingable about the flapper rotating shaft 11 in the directions of arrows B1 and B2. The separation flapper 10 lightly presses the roll sheet R by own weight. In the case where it is necessary to strongly press the roll sheet R, an urging force of an urging member such as a spring may be used. A driven roller 10*a* is rotatably disposed at a portion of the separation flapper 10 at which the separation flapper 10 and the roll sheet R are in contact with each other to reduce an effect of the pressing force on the roll sheet R. With the structure of the printing apparatus according to the present embodiment, the roll sheet R is rotated in the direction of C1 to guide the front edge of the sheet 1 of the roll sheet R to the opening portion of the route, on which the sheet 1 is guided to the printing portion 400, which is formed by the conveyance guide 12 and the separation flapper 10. When the roll sheet R rotates in the direction of C1 with the separation flapper 10 pressing the roll sheet R, the front edge of the sheet 1 of the roll sheet R that rises above the front surface of the roll sheet R catches on a separation portion 10*b* of the separation flapper 10 at an end thereof. Thus, the front edge of the sheet 1 is separated from the roll sheet R, and a state where the front edge of the sheet 1 is wound around the roll sheet R is automatically changed into a state where the front edge of the sheet 1 is located on the conveyance route (state illustrated in FIG. 4), and it is not necessary for a user to find the front edge of the sheet 1. The separation portion 10*b* is formed so as to approach the front surface of the roll sheet R as much as possible to facilitate separation of the front edge of the sheet 1 from the roll sheet R.

The sheet 1 is pulled out of the roll sheet R along the driven rotating bodies 8 and 9 and supplied on the route (supply path) formed between the separation flapper 10 and the arm member 4 after the lower surface thereof is guided by the guide portion 4*b* on the upper portion of the arm member 4. The guide portion 4*b* thus guides the lower surface of the sheet 1 that is pulled along the driven rotating bodies 8 and 9 in a manner in which the driven rotating bodies 8 and 9 are brought into pressure contact with the outer circumferential portion of the roll sheet R from below. Thus, the sheet 1 can be smoothly supplied by using the weight of the sheet 1 itself. The driven rotating bodies 8 and 9 and the guide portion 4*b* rotate in accordance with the outer diameter of the roll sheet R, and accordingly, the sheet 1 can be pulled out of the roll sheet R and conveyed with certainty without being affected by the outer diameter of the roll sheet R.

The sheet 1 pulled out of the roll sheet R passes below a lower surface 10*c* of the separation flapper 10 and passes below a lower surface 12*a* of the conveyance guide 12 (supply path). According to the present embodiment, the roll sheet R is rotated in the direction of C1 with the front edge of the sheet 1 located at an appropriate position that enables the sheet 1 to be supplied up to the supply path, and accordingly, the printing apparatus 100 can automatically guide the sheet 1 up to the supply path. Specifically, an example of the appropriate position that enables the sheet 1 to be supplied up to the supply path is a position between the driven rotating body 8 and the separation portion 10*b*.

Figure 5:
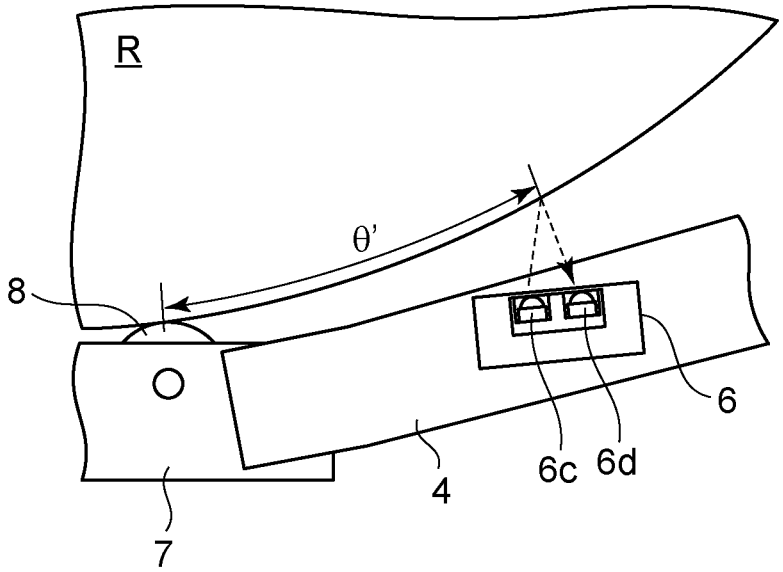
FIG. 5 is an enlarged view of a portion near a sheet sensor in the sectional view in FIG. 4.

The sheet sensor 6 detects the position of the front edge of the sheet 1. FIG. 5 is an enlarged view of a portion near the sheet sensor 6 in the sectional view in FIG. 4. The sheet sensor 6 includes a LED light emitting portion 6*c* and a light receiving portion 6*d*. LED light emitted from the LED light emitting portion 6*c* toward the roll sheet R is reflected from the front surface of the roll sheet R and is incident on the light receiving portion 6*d*. Thus, the sheet sensor 6 outputs an output value in accordance with the light incident on the light receiving portion 6*d*. The light that is emitted from the LED light emitting portion 6*c* toward the roll sheet R and that is incident on the light receiving portion 6*d* is more strongly attenuated as the length of a route on which the light passes until the light is incident increases. That is, the longer the distance (distance of a dotted line arrow in the figure) from the sheet sensor 6 to the front surface of the roll sheet R, the smaller the output value outputted from the sheet sensor 6. The shorter the distance, the larger the output value.

When the front edge of the sheet 1 is separated from the roll sheet R, the front edge of the sheet 1 hangs down toward the sheet sensor 6 by own weight. That is, the distance from the sheet sensor 6 to the front surface of the roll sheet R decreases, and the output value outputted from the sheet sensor 6 increases. In view of this, the sheet sensor 6 detects whether the front edge of the sheet 1 is located at the appropriate position that enables the sheet 1 to be automatically supplied up to the supply path when the output value increases.

The structure of the sheet sensor 6 is not limited to a sensor that uses a LED for light emission, provided that the output value changes in accordance with the distance between the sheet sensor 6 and the roll sheet R (including a front edge portion of the sheet 1). The light detected by the light receiving portion 6*d* is not limited to regular reflected light. The sheet sensor 6 is connected to the CPU 201. The CPU 201 can obtain the output value outputted from the sheet sensor 6 with convenient timing.

Figure 6:
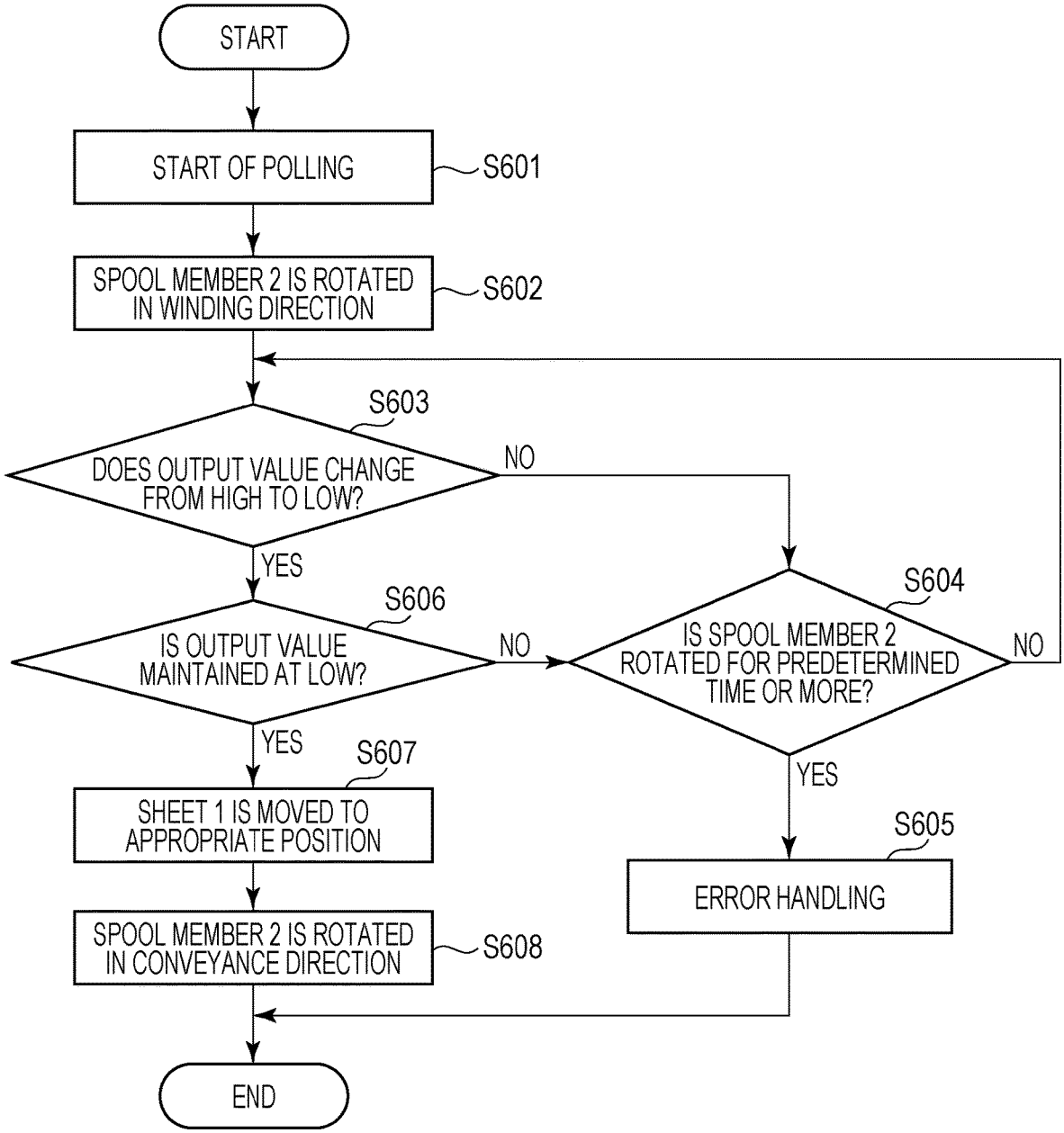
FIG. 6 is a flowchart illustrating a process of automatically supplying a sheet up to a conveyance route.

FIG. 6 is a flowchart illustrating a process of automatically supplying the sheet 1 up to the supply path. The process illustrated in the flowchart is performed in a manner in which the CPU 201 reads a program from the ROM 204 or an external storage, not illustrated, loads the program into the RAM 203, and runs the program. The process illustrated in the flowchart starts when one of the roll sensors 32 detects the spool member 2 being set in the corresponding sheet-supplying device 200. For example, the process illustrated in the flowchart may start when a user uses the operation panel 28 to instruct the automatic sheet-supplying function to start.

At S601, the CPU 201 starts polling of the output value obtained by the target sheet sensor 6.

Subsequently, at S602, the CPU 201 starts rotation of the corresponding roll-driving motor 33 to start rotation of the target spool member 2 in a winding direction. In the case where the winding manner is an inward winding manner described later, the winding direction is the direction of C2. In the case where the winding manner is an outward winding manner described later, the winding direction is the direction of C1. In an example described herein, the winding manner is the inward winding manner.

Subsequently, the CPU 201 controls operation to move the front edge of the sheet 1 to the appropriate position that enables the sheet 1 to be automatically supplied up to the supply path.

Figure 7A:
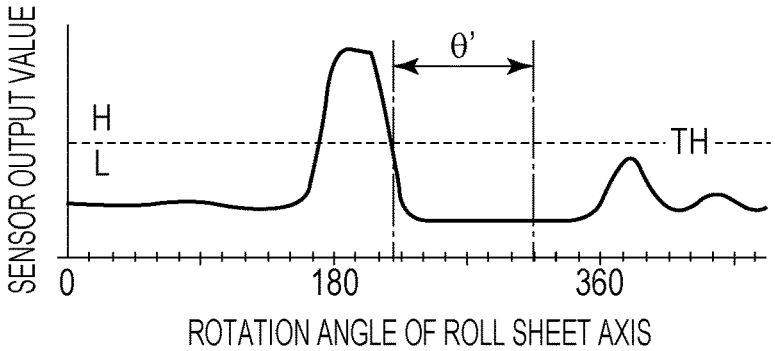
FIGS. 7A to 7C illustrate a graph illustrating variation in an output value outputted from the sheet sensor over time and sectional views of the sheet-supplying device.
Figure 7B:
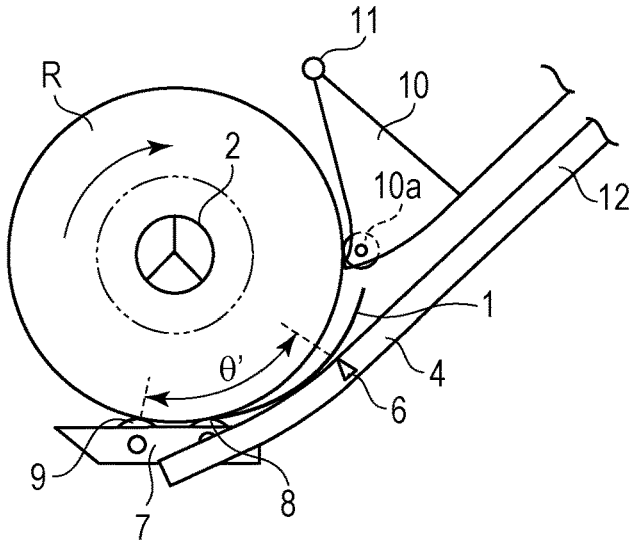

FIG. 7A is a graph illustrating variation in the output value outputted from one of the sheet sensors 6 over time. The vertical axis of the graph represents the output value outputted from the sheet sensor 6, and the horizontal axis represents the rotation angle of the roll sheet R rotated in the direction of C2 over time. The rotation angle when the CPU 201 starts the polling is regarded as 0 degree. The longer the distance from the sheet sensor 6 to the front surface of the front edge portion of the sheet 1, the smaller the output value outputted from the sheet sensor 6, and the shorter the distance, the larger the output value, as described above. The CPU 201 can detect whether the front edge of the sheet 1 has passed above each sheet sensor 6 in a manner in which the variation in the output value outputted from the sheet sensor 6 is polled.

According to the present embodiment, an output value of more than a threshold TH1 is regarded as a level H (referred to below as a level H), and an output value of the threshold TH1 or less is regarded as a level L (referred to below as a level L). The threshold TH1 is predetermined for decision and is stored in a non-volatile memory in the main body or each sheet sensor 6 of the printing apparatus 100. Specifically, the threshold TH1 is determined as (H0+L0)/2, where L0 is the output value when the front edge of the sheet 1 is located between the driven rotating body 8 and the sheet sensor 6, and H0 is the output value when the front edge of the sheet 1 is located right above the sheet sensor 6. The determined value varies due to variations of the sensor. The threshold TH1 may be determined through processes of measuring the values of L0 and H0 corresponding to the amount of light reflected from the roll sheet R by using sensors and calculating the threshold TH1 based on the measured values.

When the front edge of the sheet 1 passes through the driven roller 10*a* of the separation flapper and falls down the arm member 4 by own weight, the distance from the front edge of the sheet 1 to the front surface of the roll sheet R decreases, and the output value changes from the level L to level H. In an example illustrated in FIG. 7A, the rotation angle of the roll sheet R when the output value exceeds the threshold TH1 is about 170 degrees. For this reason, when the roll sheet R rotates at about 170 degrees from the start of the polling, it can be known that the front edge portion of the sheet 1 falls down the arm member 4 by own weight.

Figure 7C:
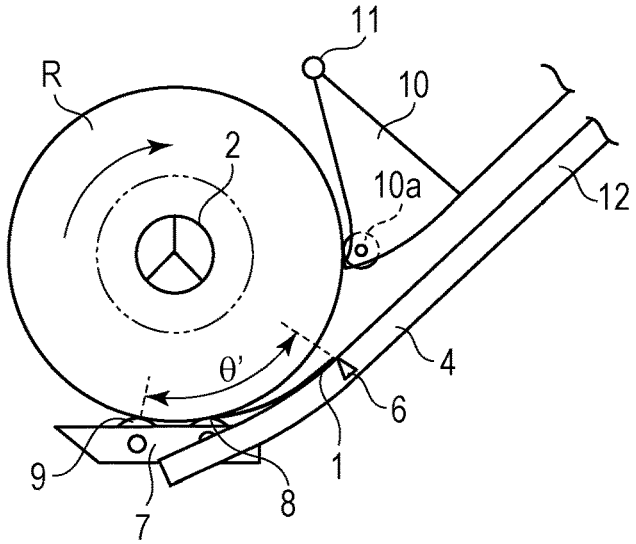

While the roll sheet R continues to rotate in the direction of C2 after the output value changes from the level L to the level H, as illustrated in FIG. 7C, the front edge of the sheet 1 passes above the sheet sensor 6. In this case, the sheet sensor 6 receives the light reflected from the front surface of the roll sheet R again, and the output value changes from the level H to the level L. After the front edge of the sheet 1 passes above the sheet sensor 6, the output value is maintained at the level L at least until the rotation in the direction of C2 continues and the front edge portion of the sheet 1 passes above the driven rotating body 9.

In view of this, after the output value obtained by the sheet sensor 6 changes from the level L to the level H, at S603, the CPU 201 decides whether the output value changes from the level H to the level L. When the decision is YES, the CPU 201 performs a process at S606. When the decision is NO, the CPU 201 performs a process at S604.

At S606, the CPU 201 decides whether the output value obtained by the sheet sensor 6 is maintained at the level L when the spool member 2 is rotated in the direction of C2 at a predetermined rotation angle A or more after the output value obtained by the sheet sensor 6 changes from the level H to the level L. The predetermined rotation angle A is an angle that is determined on the basis of an angle θ' corresponding to the angle formed between the sheet sensor 6 and the driven rotating body 9 with the center of the spool member 2 regarded as an axis. According to the present embodiment, the predetermined rotation angle is determined to be A=θ'/2. For example, the decision may be made in such a manner that whether the output value obtained by the sheet sensor 6 is maintained at the level L when the spool member 2 is rotated in the direction of C2 for a predetermined time is decided after the output value obtained by the sheet sensor 6 changes from the level H to the level L. When the decision is YES, the CPU 201 performs a process at S607. When the decision is NO, the CPU 201 performs a process at S604. For example, in the case where the sheet 1 separated from the roll sheet R is wavy, the decision may be NO. In such a case, the output value obtained by the sheet sensor 6 at a convex portion of the wavy sheet 1 changes from the level H to the level L. Subsequently, however, the output value obtained by the sheet sensor 6 at a concave portion of the sheet 1 changes from the level L to the level H again. That is, since the change in the output value obtained by the sheet sensor 6 from the level H to the level L does not necessarily mean that the front edge of the sheet 1 passes above the sheet sensor 6, the above decision is made to reduce the occurrence of a detection error.

When the decision at S603 is NO or when the decision at S606 is NO, at S604, the CPU 201 decides whether the spool member 2 is rotated at a predetermined angle or more or for a predetermined time or more. When the decision is YES, the CPU 201 performs the process at S605. When the decision is NO, the CPU 201 performs the process at S603 again.

At S605, the CPU 201 performs a process of error handling. Specifically, the process of error handling is that the CPU 201 causes the operation panel 28 to display a screen for prompting a user to manually guide the front edge of the sheet 1 to the supply path. Subsequently, the process is finished.

The case where the decision at S606 is YES indicates that the front edge of the sheet 1 passes above the sheet sensor 6 when the output value obtained by the sheet sensor 6 changes from the level H to the level L. That is, this means that the front edge of the sheet 1 is located above (near) the sheet sensor 6 when the output value obtained by the sheet sensor 6 changes from the level H to the level L. The rotation angle B that is needed to move the sheet 1 to the appropriate position that enables the sheet 1 to be automatically supplied up to the supply path from above the sheet sensor 6 can be predetermined on the basis of the structure of the printing apparatus. Accordingly, at S607, the CPU 201 causes the spool member 2 to further rotate in the direction of C2 at the rotation angle B determined in consideration for the position of the front edge of the sheet 1 to move the front edge of the sheet 1 to the appropriate position that enables the sheet 1 to be automatically supplied up to the supply path. Subsequently, the CPU 201 stops the rotation of the spool member 2. The CPU 201 may not stop the rotation of the spool member 2 right after the decision at S606 is made to be YES, for example, provided that the rotation of the spool member 2 can be quickly stopped. The CPU 201 may stop the rotation of the spool member 2 when the decision at S606 is made to be YES. Through the above processes, the front edge of the sheet 1 is moved to the appropriate position that enables the sheet 1 to be automatically supplied up to the supply path.

Subsequently, at S608, the CPU 201 starts rotation of the roll-driving motor 33 to start rotation of the spool member 2 in the conveyance direction. The conveyance direction is opposite the winding direction. That is, when the winding manner is the inward winding manner, the conveyance direction is the direction of C1. At this time, the front edge of the sheet 1 falls down the arm member 4 by own weight. Accordingly, when the spool member 2 rotates in the direction of C1, the front edge of the sheet 1 is pulled out of the roll sheet R, moves along the arm member 4, and consequently, is guided to the supply path. Even when the sheet 1 moves along the roll sheet R due to, for example, a curl, the outer circumferential surface of the roll sheet R and the front edge of the sheet 1 are separated from each other by using the separation flapper 10 (front edge of the sheet 1 is separated from the outer circumferential surface of the roll sheet R). Thus, the front edge of the sheet 1 is guided to the supply path.

After the front edge of the sheet 1 is guided to the supply path, the CPU 201 causes the spool member 2 to continue to rotate in the direction of C1. While the spool member 2 is rotating in the direction of C1, the sheet sensor 16 detects the front edge of the sheet 1 passing above the sheet sensor 16. In the case where the result of detection is inputted from the sheet sensor 16, the CPU 201 causes the conveyance-roller-driving motor 35 to impart forward rotation in the direction of an arrow D1 to the conveyance roller 14 to convey the sheet 1 to the printing portion 400.

Such an automatic conveyance function enables a user to omit manual operation to guide the front edge of the sheet 1 to the supply path.

In some cases, for example, when no spool member 2 is set in one of the sheet-supplying devices 200, or when no roll sheet R is set on the spool member 2 set in one of the sheet-supplying devices 200, the automatic conveyance function is instructed to start. In these cases, there is no roll sheet R that reflects the light emitted from the light emitting portion of the corresponding sheet sensor 6, and the output value obtained by the sheet sensor 6 greatly decreases. For this reason, for example, the CPU 201 may perform the process of error handling also in the case where the output value obtained by the sheet sensor 6 greatly decreases. In this case, specifically, the CPU 201 decides whether the output value obtained by the sheet sensor 6 is maintained at a level smaller than a predetermined threshold TH2 when the spool member 2 is rotated in the winding direction at a predetermined rotation angle C or more. When the decision is YES, the CPU 201 performs the process of error handling. In the process of error handling, the operation panel 28 may display a screen that differs from the screen that is displayed in the process of error handling at S605. For example, the operation panel 28 may display a screen to prompt a user to set the spool member 2 or the roll sheet R. Subsequently, in the case where an input representing that the spool member 2 or the roll sheet R has been set is accepted from a user, the processes from S601 may be performed again.

Description of Winding

According to the present embodiment, in a state where the printing apparatus 100 is in a "one-side winding printing mode" or the "duplex printing mode", described later, a printed sheet can be wound around one of the paper tubes 27 set in the two sheet-supplying devices 200. The winding manner used at this time is classified into the inward winding manner and the outward winding manner. These manners will now be described. According to the present embodiment, the paper tubes 27 are members separated from the spool members 2. For example, the sheets may be wound directly around the spool members 2. In this case, the spool members 2 are regarded as the paper tubes 27.

Figure 9:
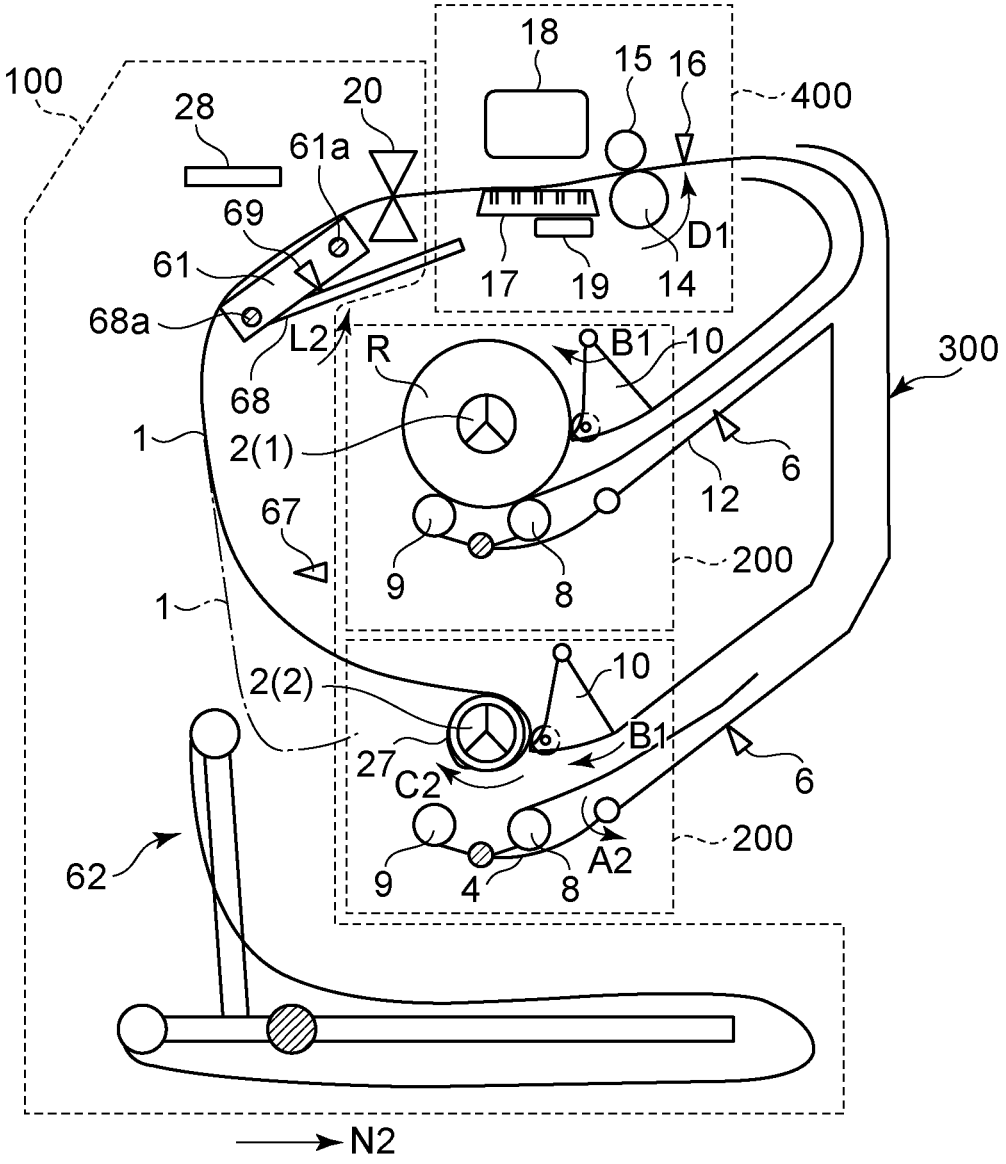
FIG. 9 illustrates the state of the printing apparatus that is winding the sheet around a paper tube in an inward winding manner.
Figure 10:
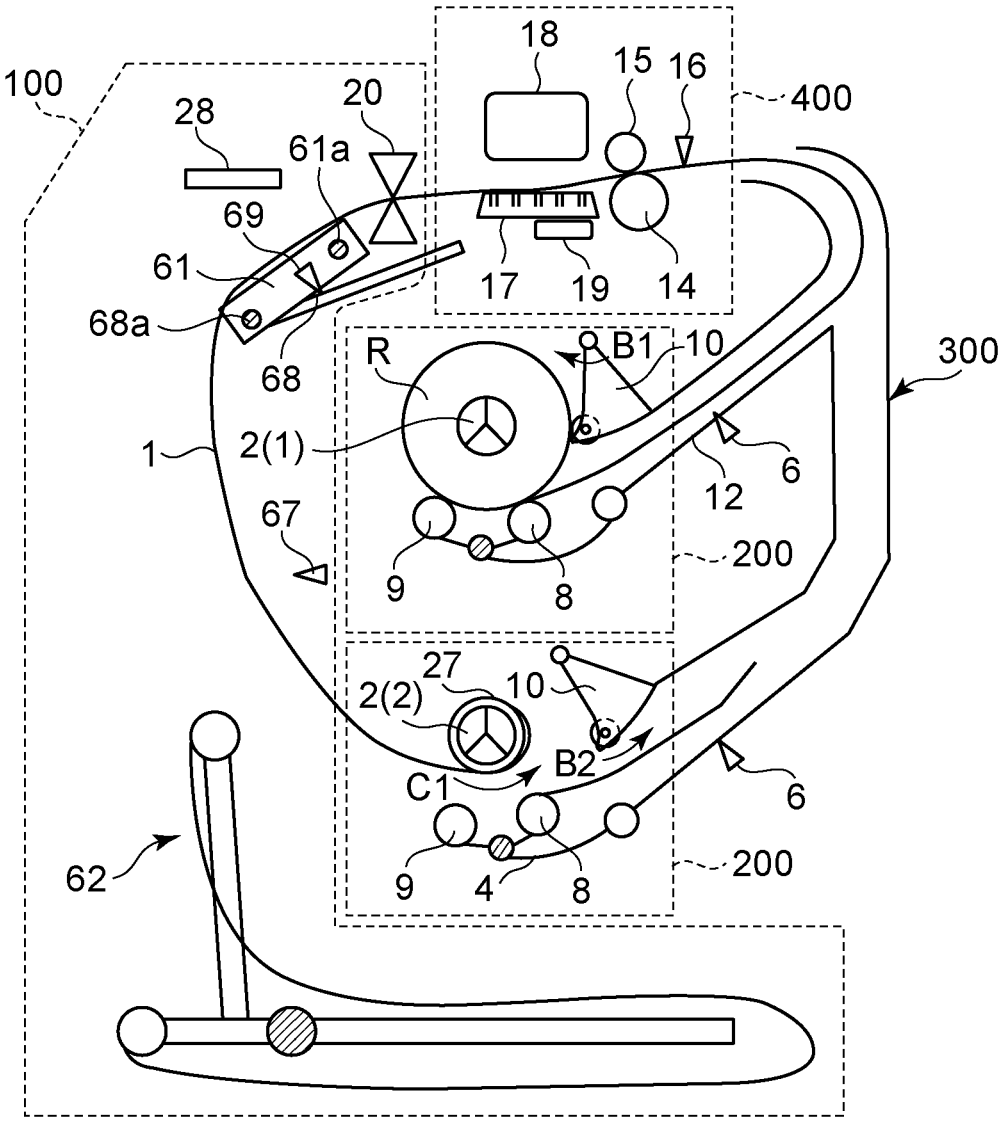
FIG. 10 illustrates the state of the printing apparatus that is winding the sheet around the paper tube in an outward winding manner.

FIG. 9 illustrates the state of the printing apparatus 100 that is winding the sheet 1 around one of the paper tubes 27 in the inward winding manner. The inward winding manner is a manner in which the sheet 1 is wound such that the surface of the sheet 1 on which the image is formed faces the inner side. In other words, the inward winding manner is a manner in which the sheet 1 is wound such that the surface of the sheet 1 on which the image is formed is in contact with the paper tube 27. FIG. 10 illustrates the state of the printing apparatus 100 that is winding the sheet 1 in the outward winding manner. The outward winding manner is a manner in which the sheet 1 is wound such that the surface of the sheet 1 on which the image is formed faces the outer side. In other words, the outward winding manner is a manner in which the sheet 1 is wound such that the surface of the sheet 1 on which the image is not formed is in contact with the paper tube 27.

In the following description, the upper sheet-supplying device 200 is used as the supplying unit (supplying portion) for the sheet 1, and the lower sheet-supplying device 200 is used as the winding unit (winding portion) for the sheet 1. The present disclosure, however, is not limited thereto. That is, the relationship between the supplying unit and the winding unit may be reversed. The upper and lower sheet-supplying devices 200 may each include a sensor that detects a flange attachment, not illustrated, which is mounted on the reference spool flange 23 of the corresponding spool member 2. In this case, which sheet-supplying device 200 is used as the supplying unit for the sheet 1 is decided in accordance with the result of detection by each sensor. More specifically, for example, the sheet-supplying device 200 in which the spool member including the flange attachment on the reference spool flange 23 is set is decided as the supplying unit. The sheet-supplying device 200 in which the spool member including no flange attachment on the reference spool flange 23 is set is decided as the winding unit. Which sheet-supplying device 200 is used as the supplying unit for the sheet 1 may be decided on the basis of user operations on a switch for the supplying unit.

Figure 11A:
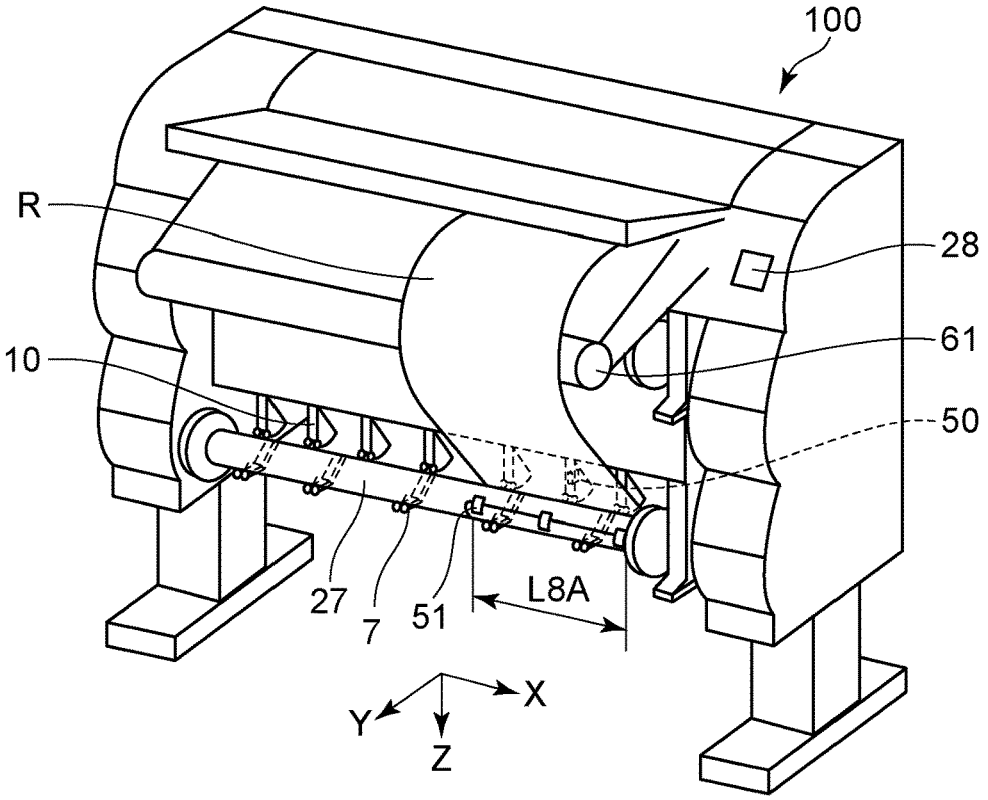
FIGS. 11A and 11B illustrate a securing method to wind the sheet in the inward winding manner, and a securing method to wind the sheet in the outward winding manner.
Figure 11B:
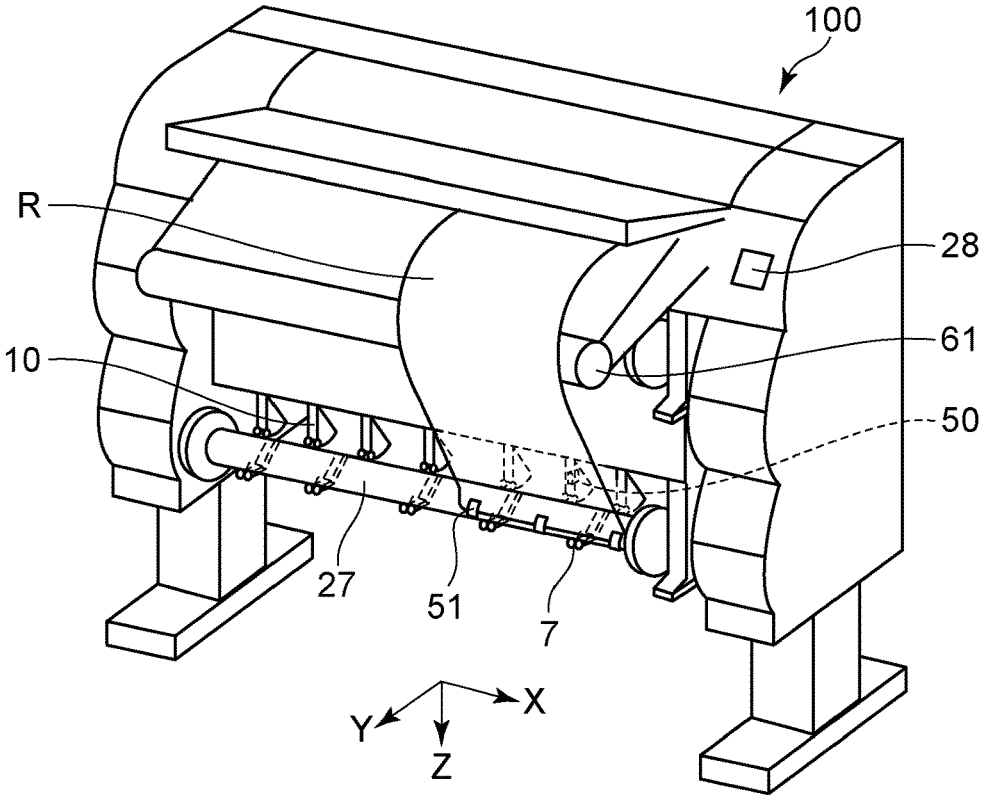

When the sheet 1 passes through the sheet outlet after a surface of the sheet 1 is printed, the sheet 1 hangs down by own weight. It is necessary for a user to secure the sheet 1 to the paper tube 27 set on the spool member 2 set in one of the sheet-supplying devices 200 to wind the hanging sheet 1 by the sheet-supplying device 200. Accordingly, as illustrated in FIGS. 11A and 11B, the user secures the sheet 1 to the paper tube 27 set on the spool member 2 set in the sheet-supplying device 200 by using an adhesive material such as a tape. At this time, the user secures the sheet 1 such that the front edge side of the sheet 1 is parallel to the axis of the paper tube 27 to enable the sheet 1 to be wound without distortion. The method of securing the sheet 1 to the paper tube 27 is not limited to the use of an adhesive material such as a tape. For example, the paper tube 27 may have a structure to nip the front edge of the sheet 1, and the sheet 1 may be secured to the paper tube 27 by using the structure.

FIG. 11A illustrates the securing method used when the sheet 1 is wound in the inward winding manner. Specifically, after the sheet 1 is moved so as to pass between the corresponding spool member 2 and the main body of the printing apparatus 100, the sheet 1 is secured to the corresponding paper tube 27 by using a tape 51 such that the surface of the sheet 1 on which the image is formed is in contact with the front surface of the paper tube 27. The spool member 2 is rotated in the direction of C2 with the sheet 1 thus secured to the paper tube 27, and the sheet 1 is wound around the paper tube 27 in the inward winding manner.

FIG. 11B illustrates the securing method used when the sheet 1 is wound in the outward winding manner. Specifically, the sheet 1 is wound from the side of the corresponding spool member opposite the side facing the main body of the printing apparatus 100, and the sheet 1 is secured to the corresponding paper tube 27 by using the tape 51 such that the surface of the sheet 1 on which the image is not formed is in contact with the front surface of the paper tube 27. The spool member 2 is rotated in the direction of C1 with the sheet 1 thus secured to the paper tube 27, and the sheet 1 is wound around the paper tube 27 in the outward winding manner.

Description of Operation Mode

The operation modes of the printing apparatus 100 will now be described. According to the present embodiment, the operation modes in which the printing apparatus 100 can operate are classified into three modes: the "one-side printing mode", the "one-side winding printing mode", and the "duplex printing mode". The printing apparatus 100 operates in one of the three operation modes that is selected for the printing apparatus 100.

In the "one-side printing mode", the printing apparatus 100 first prints a first surface (front surface) of the sheet 1 pulled out of the upper or lower sheet-supplying device 200. Subsequently, in the "one-side printing mode", the printing apparatus 100 does not wind the printed sheet 1 around the spool members 2 set in the sheet-supplying devices 200 but cuts the printed sheet 1.

In the "one-side winding printing mode", the printing apparatus 100 first prints the first surface (front surface) of the sheet 1 pulled out of the upper or lower sheet-supplying device 200. Subsequently, in the "one-side winding printing mode", the printing apparatus 100 winds the printed sheet 1 by the other sheet-supplying device 200.

In the "duplex printing mode", the printing apparatus 100 first prints the first surface (front surface) of the sheet 1 pulled out of the upper or lower sheet-supplying device 200. Subsequently, in the "duplex printing mode", the printing apparatus 100 winds the printed sheet 1 by the other sheet-supplying device 200. Subsequently, in the "duplex printing mode", the printing apparatus 100 supplies the wound sheet 1 up to the supply path again, and prints a second surface (back surface) opposite the first surface of the sheet 1.

The operation modes are selected for the printing apparatus 100, for example, in a manner in which user operations are accepted via the operation panel 28. According to the present embodiment, the "one-side printing mode" is selected for the printing apparatus 100 in an initial state in which the printing apparatus 100 is just switched on. For this reason, when a user operates the printing apparatus 100 in another operation mode other than the "one-side printing mode", the user operates, for example, the operation panel 28 to select the other operation mode other than the "one-side printing mode" for the printing apparatus 100. According to the present embodiment, the printing apparatus 100 includes mode switches, not illustrated, disposed on a component other than the operation panel 28. A user can switch configurations representing whether the printed sheet 1 is wound by one of the sheet-supplying devices 200 in a manner in which the user operates the mode switches. That is, the user can decide whether the "one-side printing mode" or another mode ("one-side winding printing mode" or the "duplex printing mode") other than the "one-side printing mode" is selected as the operation mode of the printing apparatus 100. In the case where another mode other than the "one-side printing mode" is selected as the operation mode of the printing apparatus 100, the operation panel 28 displays a screen to ask a user which of the "one-side winding printing mode" and the "duplex printing mode" is selected for the printing apparatus 100. The user inputs a response in the screen to select the "one-side winding printing mode" or the "duplex printing mode" for the printing apparatus 100.

According to the embodiment, a user can select one of the operation modes for the printing apparatus 100 to operate the printing apparatus 100 in the selected operation mode for printing.

For example, in the case where the printing apparatus 100 is switched off with the operation mode of the printing apparatus 100 changed, the CPU 201 may cause, for example, the ROM 204 to store the operation mode changed before the printing apparatus 100 is switched off. In this case, the CPU 201 may select the changed operation mode for the printing apparatus 100 as the initial operation mode when the printing apparatus 100 is switched on after that.

According to the embodiment described above, the printing apparatus 100 prints in the operation mode selected for the printing apparatus 100 when a print instruction is accepted, but is not limited to the embodiment. For example, in the case where a print job includes information about a print configuration to instruct one of the operation modes for printing, the print job is performed in the operation mode corresponding to the information about the print configuration.

Description of Print in One-Side Printing Mode

Figure 12:
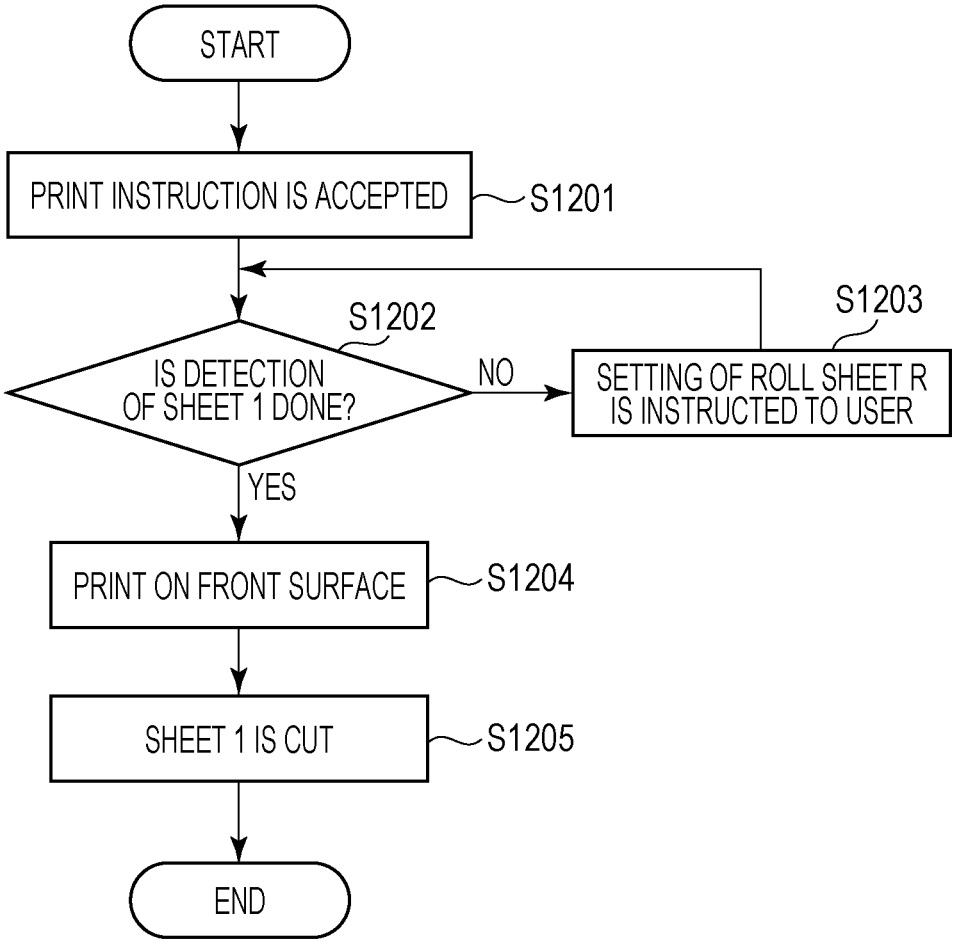
FIG. 12 is a flowchart illustrating a printing process that the printing apparatus performs in a "one-side printing mode".

FIG. 12 is a flowchart illustrating a printing process that the printing apparatus 100 performs in the "one-side printing mode". The process illustrated in the flowchart is performed in a manner in which the CPU 201 reads a program from the ROM 204 or an external storage, not illustrated, loads the program into the RAM 203, and runs the program. An initializing process or a user operation starts the process illustrated in the flowchart with the printing apparatus 100 in the "one-side printing mode".

At S1201, the CPU 201 first accepts a print instruction. The print instruction may be a direct user operation on the printing apparatus 100 by using, for example, the operation panel 28 to instruct start of the printing process, or may be a print job received from an external apparatus outside the printing apparatus 100 with wireless communications or wired communications.

Subsequently, at S1202, the CPU 201 decides whether detection of the sheet 1 is done by using the sheet sensor 16. In a state where the sheet 1 is pulled out of the roll sheet R set in the corresponding sheet-supplying device 200 by the above automatic sheet-supplying function, detection of the sheet 1 is done by using the sheet sensor 16. For example, the decision may be made by deciding whether the roll sensor 32 included in the upper sheet-supplying device 200 detects the corresponding spool member 2 set at the position at which the spool member 2 is to be set. For example, the decision may be made by deciding whether the sheet sensor 6 included in the upper sheet-supplying device 200 detects the sheet 1. When the decision is YES, the CPU 201 performs a process at S1204. When the decision is NO, the CPU 201 performs a process at S1203.

At S1203, the CPU 201 instructs a user to set the roll sheet R in the upper sheet-supplying device 200. Specifically, for example, the CPU 201 causes the operation panel 28 to display a screen to instruct setting of the roll sheet R in the upper sheet-supplying device 200. Subsequently, the CPU 201 performs the process at S1202 again.

Subsequently, at S1204, the CPU 201 causes the printing head 18 to form an image based on the print instruction in a region of the front surface of the sheet 1 that faces the printing head 18 while the sheet 1 is appropriately conveyed. In a state where the printing apparatus 100 is in the "one-side printing mode", the CPU 201 does not leave a margin in a region from the front edge of the sheet 1 to the region of the sheet 1 in which the image is formed, or leaves a small margin only. Thus, the CPU 201 enables a useless area of the sheet 1 to be reduced.

Subsequently, at S1205, the CPU 201 causes the cutter 20 to cut the sheet 1 when the rear edge portion of the region of the sheet 1 in which the image is formed is conveyed to the position of the cutter 20. Thus, the sheet 1 on which the image is formed falls down by own weight, and is accommodated in a basket 62. The sheet 1 is cut for every image. Accordingly, in the case where images are formed on the sheet 1, the sheet 1 is cut multiple times. The printing head 18 may print a next image at the same time as the sheet 1 is cut.

Description of Print in One-Side Winding Printing Mode

Figure 13:
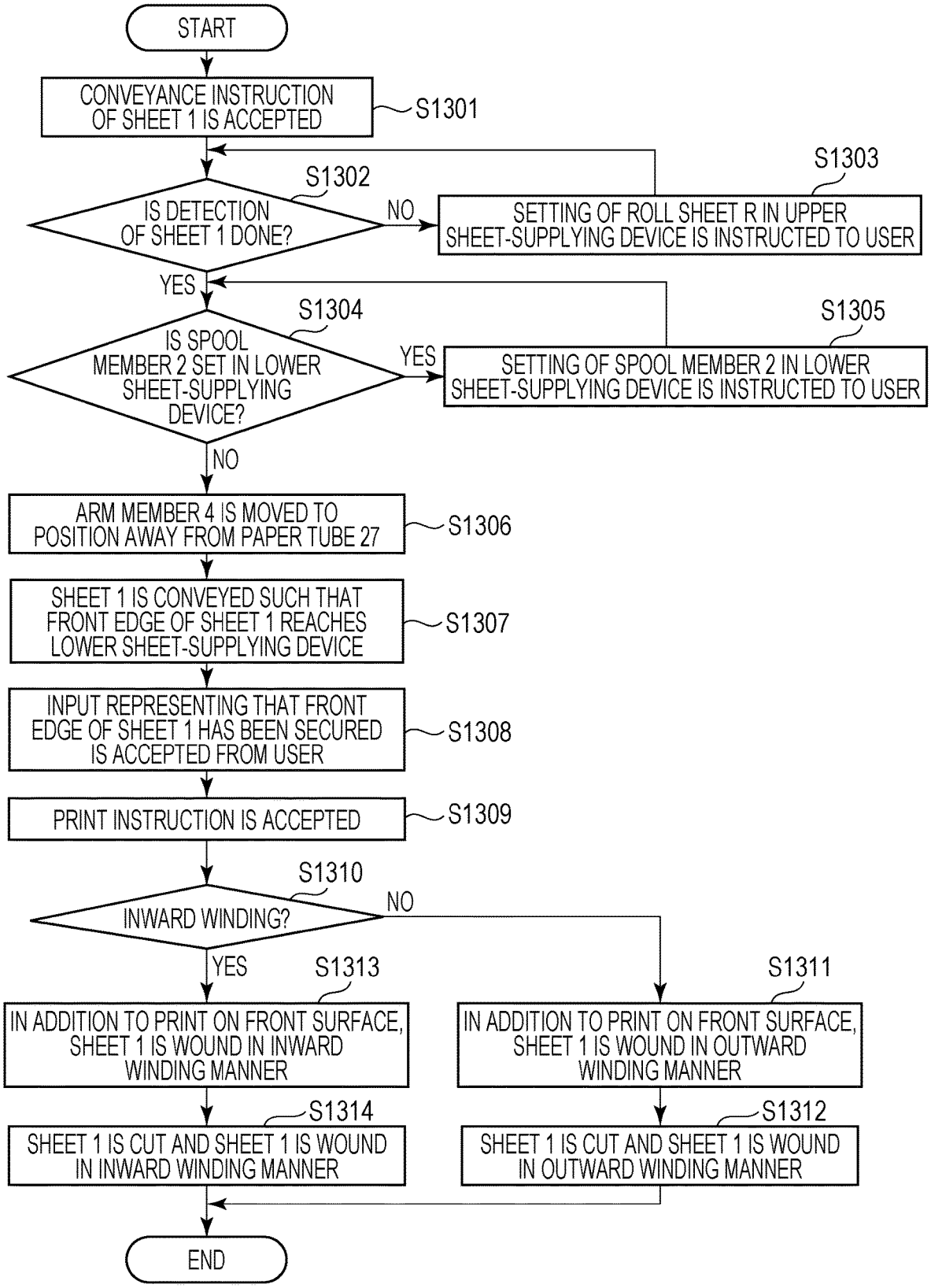
FIG. 13 is a flowchart illustrating a printing process that the printing apparatus performs in a "one-side winding printing mode".

FIG. 13 is a flowchart illustrating a printing process that the printing apparatus 100 performs in the "one-side winding printing mode". The process illustrated in the flowchart is performed in a manner in which the CPU 201 reads a program from the ROM 204 or an external storage, not illustrated, loads the program into the RAM 203, and runs the program. A user operation, for example, starts the process illustrated in the flowchart with the printing apparatus 100 in the "one-side winding printing mode". According to the present embodiment, the upper sheet-supplying device 200 serves as the supplying unit, and the lower sheet-supplying device 200 serves as the winding unit for printing.

It is necessary to secure the front edge of the sheet 1 to the paper tube 27 set on the spool member 2 set in the lower sheet-supplying device 200 to wind the printed sheet 1 by the lower sheet-supplying device 200 as described above. Accordingly, at S1301, the CPU 201 first accepts a conveyance instruction of the sheet 1 from a user via the operation panel 28 or a physical button, not illustrated.

Subsequently, at S1302, the CPU 201 decides whether the sheet sensor 16 detects the sheet 1. The detail of the decision is the same as in the process at S1202. For example, the decision may be made by deciding whether the roll sensor 32 included in the upper sheet-supplying device 200 detects the corresponding spool member 2 set at the position at which the spool member 2 is to be set. Alternatively, for example, the decision may be made by deciding whether the sheet sensor 6 included in the upper sheet-supplying device 200 detects the sheet 1. When the decision is YES, the CPU 201 performs a process at S1304. When the decision is NO, the CPU 201 performs a process at S1303.

At S1303, the CPU 201 instructs a user to set the roll sheet R in the upper sheet-supplying device 200. The detail of the instruction is the same as in the process at S1203. Subsequently, the CPU 201 performs the process at S1302 again.

At S1304, the CPU 201 decides whether the roll sensor 32 included in the lower sheet-supplying device 200 detects the corresponding spool member 2 set at the position at which the spool member 2 is to be set. When the decision is YES, the CPU 201 performs a process at S1306. When the decision is NO, the CPU 201 performs a process at S1305. When the decision is YES, the CPU 201 may also decide whether the roll sheet R is set on the spool member 2 set in the lower sheet-supplying device 200. When the decision is NO, the CPU 201 performs the process at S1306. When the decision is YES, the CPU 201 may cause the operation panel 28 to display a screen to instruct a user to remove the roll sheet R from the spool member 2 set in the lower sheet-supplying device 200 or to set the paper tube 27 on the spool member 2. The decision whether the roll sheet R is set on the spool member 2 set in the lower sheet-supplying device 200 is made, for example, by detecting the magnitude of the output value of the roll sensor 32 and the sheet sensor 6. After an input representing that an operation based on the instruction is performed is accepted, the CPU 201 performs the process at S1306.

At S1305, the CPU 201 instructs a user to set the spool member 2 in the lower sheet-supplying device 200. Specifically, for example, the CPU 201 causes the operation panel 28 to display a screen to instruct setting of the spool member 2 in the lower sheet-supplying device 200. At this time, in addition to setting of the spool member 2 in the lower sheet-supplying device 200, setting of the paper tube 27 on the spool member 2 may be instructed. Subsequently, the CPU 201 performs the process at S1304.

In a state where the arm member 4 of the lower sheet-supplying device 200 is in pressure contact with the corresponding paper tube 27, the arm member 4 inhibits the front edge of the sheet 1 from being secured to the paper tube 27. For this reason, at S1306, the CPU 201 causes the arm member 4 to be moved to a position away from the paper tube 27.

Subsequently, at S1307, the CPU 201 causes the sheet 1 to be conveyed such that the front edge of the sheet 1 reaches the lower sheet-supplying device 200 before the printing portion 400 prints the sheet 1. After the sheet 1 is thus conveyed, a user secures the front edge of the sheet 1 to the paper tube 27 set on the spool member 2 set in the lower sheet-supplying device 200. At this time, the CPU 201 may cause the operation panel 28 to display a screen to instruct a user to secure the front edge of the sheet 1 to the paper tube 27 set on the spool member 2 set in the lower sheet-supplying device 200. In a state where the printing apparatus 100 is in the "one-side winding printing mode", the front edge of the sheet 1 may be secured by a method for the inward winding manner or the outward winding manner. This leaves a margin having a predetermined length L1 between the front edge of the sheet 1 and the region of the sheet 1 in which an image is formed. The predetermined length L1 is a length from the position of the sheet 1 that is on the conveyance route and that faces the printing head 18 to the position at which the front edge of the sheet 1 is secured.

Subsequently, at S1308, the CPU 201 accepts an input representing that the front edge of the sheet 1 has been secured from a user via, for example, the operation panel 28.

Subsequently, at S1309, the CPU 201 accepts a print instruction. This process is the same as the process at S1201.

Subsequently, at S1310, the CPU 201 performs a process of detecting inward winding (process of deciding inward winding). Specifically, the process of detecting inward winding is a process in which whether the front edge of the sheet 1 is secured by the securing method for the inward winding manner is decided by using an inward-winding detecting sensor 50. This is necessary because the direction of rotation of each spool member 2 differs depending on a winding method, and the CPU 201 needs to determine which winding method is to be used. When the decision is YES, the CPU 201 determines that the sheet 1 is wound in the inward winding manner and performs a process at S1313. When the decision is NO, the CPU 201 determines that the sheet 1 is wound in the outward winding manner and performs a process at S1311.

The process of detecting inward winding will now be described in detail.

Figure 15A:
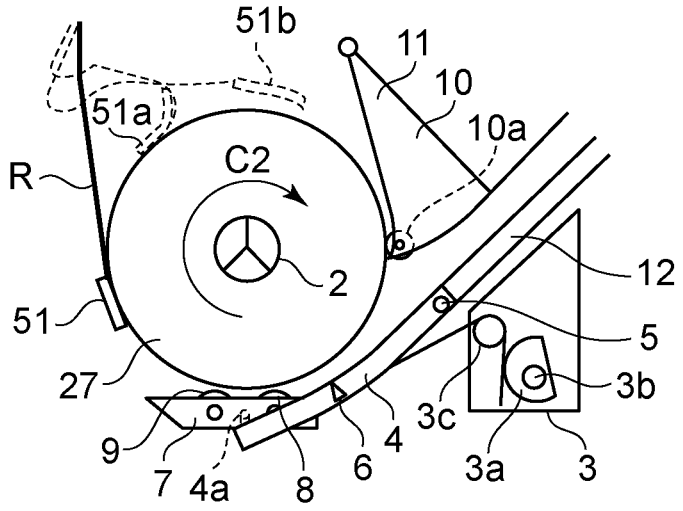
FIGS. 15A to 15C illustrate states of the sheet-supplying device in the case where the sheet is wound with the front edge of the sheet secured by using a tape.
Figure 15B:
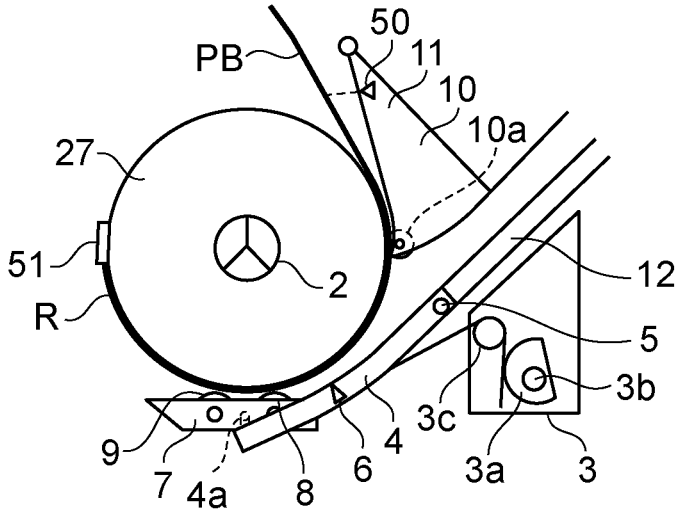
Figure 15C:
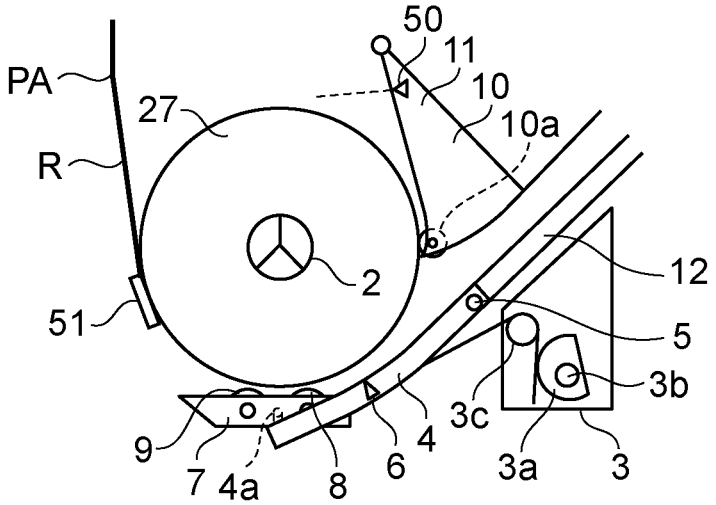

FIG. 15B illustrates the state of the lower sheet-supplying device 200 with the front edge of the sheet 1 secured to the spool member 2 set in the lower sheet-supplying device 200 by the securing method for the inward winding manner by using the tape 51. FIGS. 15A and 15C illustrate states of the lower sheet-supplying device 200 with the front edge of the sheet 1 secured to the spool member 2 set in the lower sheet-supplying device 200 by the securing method for the outward winding manner by using the tape 51. The securing method for the inward winding manner is illustrated in FIG. 11A. The securing method for the outward winding manner is illustrated in FIG. 11B.

One of the separation flappers 10 is equipped with the inward-winding detecting sensor 50 including a light emitting portion (not illustrated) and a light receiving portion (not illustrated). When light is emitted from the light emitting portion with the front edge of the sheet 1 secured by the securing method for the inward winding manner, as illustrated in FIG. 15B, the sheet 1 is located near the light emitting portion (on a path PB). Accordingly, the light emitted from the light emitting portion is reflected from the sheet 1, and the light receiving portion receives the reflected light. That is, the output value outputted from the inward-winding detecting sensor 50 is a large value. In view of this, the CPU 201 decides that the front edge of the sheet 1 is secured by the securing method for the inward winding manner when the output value outputted from the inward-winding detecting sensor 50 is a predetermined threshold or more.

When light is emitted from the light emitting portion with the front edge of the sheet 1 secured by the securing method for the outward winding manner, as illustrated in FIG. 15C, the sheet 1 is located at a location away from the light emitting portion (on a path PA). Accordingly, the light emitted from the light emitting portion diffuses before the light reaches the sheet 1 and is not reflected from the sheet 1, and the light receiving portion does not receive reflected light. That is, the output value outputted from the inward-winding detecting sensor 50 is a small value. In view of this, the CPU 201 decides that the front edge of the sheet 1 is not secured by the securing method for the inward winding manner when the output value outputted from the corresponding inward-winding detecting sensor 50 is less than a predetermined threshold.

The inward-winding detecting sensor 50 is disposed so as to be able to detect the route on which the sheet 1 passes in the case where the front edge of the sheet 1 is secured by the securing method for the inward winding manner. The inward-winding detecting sensor 50 is preferably disposed such that the output value outputted from the inward-winding detecting sensor 50 greatly differs between the case where the front edge of the sheet 1 is secured by the securing method for the inward winding manner and the case where the front edge of the sheet 1 is not secured by the securing method for the inward winding manner. Specifically, for example, the inward-winding detecting sensor 50 is preferably disposed such that the light receiving portion does not receive light reflected from the corresponding paper tube 27 in the case where the front edge of the sheet 1 is secured by the securing method for the outward winding manner.

A sheet 8 to 60 inches wide is typically used for each roll sheet R. Accordingly, the position of the inward-winding detecting sensor 50 disposed in the corresponding sheet-supplying device 200 preferably enables the process of detecting inward winding regardless of the width of the sheet wound around each spool member. In the description, the minimum width of the roll sheets R that can be set in the sheet-supplying devices 200 is referred to as a minimum roll sheet width L8A, and the maximum width of the roll sheets R that can be set in the sheet-supplying devices 200 is referred to as a maximum roll sheet width L8B. According to the present embodiment, the minimum width is 8 inches, and the maximum width is 60 inches.

Figure 16:
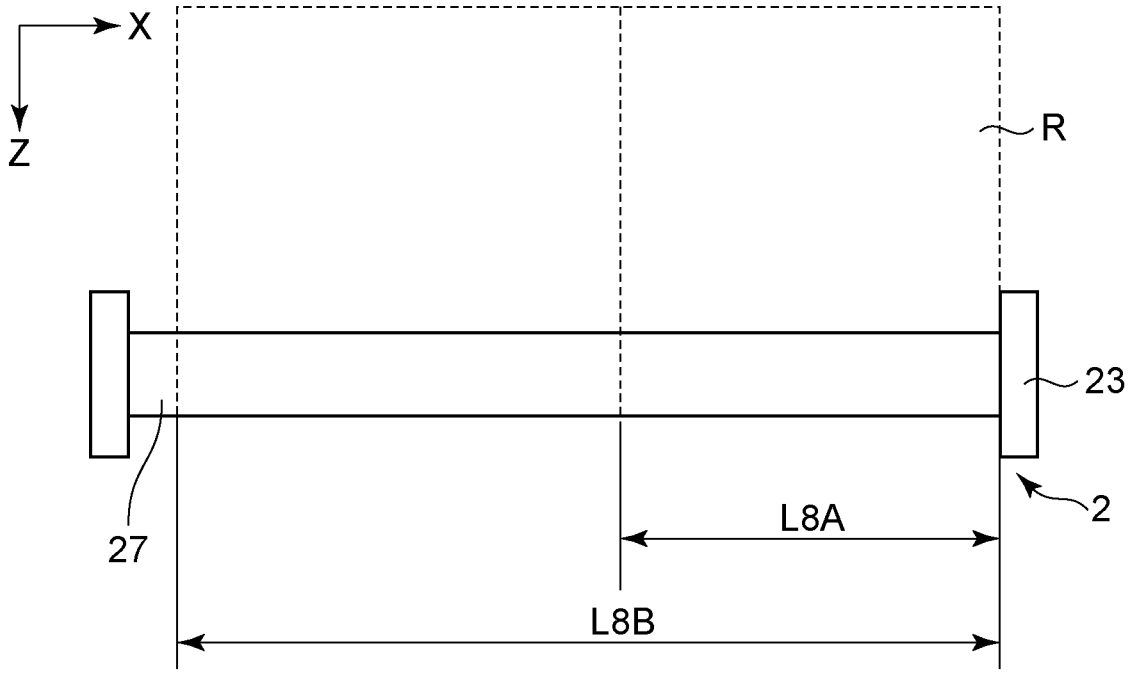
FIG. 16 is a front view of the spool member.

FIG. 16 is a front view of one of the spool members 2. The position of the inward-winding detecting sensor 50 in the X-direction in the figure will be described with reference to FIG. 16. According to the present embodiment, when each roll sheet R is set on the corresponding spool member 2, a user inserts the spool shaft 21 into the hollow portion of the roll sheet R until the button surface of the roll sheet R on the right-hand side in the figure comes into contact with the reference spool flange 23, as described above. Accordingly, the roll sheet R set on the spool member 2 is located right inside the reference spool flange 23 regardless of the width of the sheet. In the spool member 2, a position the minimum roll sheet width L8A away from the position of the reference spool flange 23 in the direction toward the inside of the spool member 2 is referred to as a position A. According to the present embodiment, the inward-winding detecting sensor 50 is disposed so as to be able to detect a region of the spool member 2 between the reference spool flange 23 and the position A. Specifically, the inward-winding detecting sensor 50 is disposed on the back side of the printing apparatus 100 above the center of the lower paper tube in the gravity direction. It is only necessary for the inward-winding detecting sensor 50 to be able to detect part of the above region, not the entire region.

A position the maximum roll sheet width L8B away from the position of the reference spool flange 23 in the direction toward the inside of the spool member 2 is referred to as a position B. For example, in the case where the inward-winding detecting sensor 50 is disposed so as to be able to detect only a region between the position A and the position B, the inward-winding detecting sensor 50 cannot detect a roll sheet R having the minimum roll sheet width L8A. According to the present embodiment, the inward-winding detecting sensor 50 is disposed at the above position in the sheet-supplying device 200, and this enables the process of detecting inward winding regardless of the width of the roll sheet R.

For example, when each roll sheet R is set on the corresponding spool member 2, the bottom surface of the roll sheet R comes into contact with a portion other than the reference spool flange 23 in some cases. In this case, the inward-winding detecting sensor 50 may be disposed at a position in accordance with the position of contact with the bottom surface of the roll sheet R. Specifically, an example of this position is a position at which a region between the position of contact of the spool member 2 with the bottom surface of the roll sheet R and the position minimum roll sheet width L8A away from the position of the contact with the bottom surface of the roll sheet R in the direction toward the inside of the spool member 2 can be detected. For example, in the case where the roll sheet R is set in a substantially central region of the spool member 2, the inward-winding detecting sensor 50 may be disposed so as to be able to detect the substantially central region of the spool member 2. It is only necessary for the inward-winding detecting sensor 50 to be thus disposed at an appropriate position in accordance with the position of the roll sheet R set on the spool member 2.

At S1311, the CPU 201 causes the printing head 18 to form the image based on the print instruction in a region of the front surface of the sheet 1 that faces the printing head 18 while the sheet 1 is appropriately conveyed. At the same time, the CPU 201 causes the lower spool member 2 to rotate in the direction of C1 to wind the printed sheet 1 around the lower paper tube 27 in the outward winding manner.

Subsequently, at S1312, the CPU 201 causes the cutter 20 to cut the sheet 1 when the rear edge portion of the region of the sheet 1 in which the image is formed is conveyed to the position of the cutter 20. The CPU 201 causes the lower spool member 2 to further rotate in the direction of C1 to wind the printed sheet 1 around the lower paper tube 27 until the entire sheet is wound. Subsequently, the process is finished.

At S1313, the CPU 201 causes the printing head 18 to form the image based on the print instruction in the region of the front surface of the sheet 1 that faces the printing head 18 while the sheet 1 is appropriately conveyed. At the same time, the CPU 201 causes the lower spool member 2 to rotate in the direction of C2 to wind the printed sheet 1 around the lower paper tube 27 in the inward winding manner. When the sheet 1 is wound in the inward winding manner, the CPU 201 causes the corresponding arm member 4 to come into contact with a roll sheet R formed by winding the sheet 1. This reduces the occurrence of slack and distortion of the sheet 1 while the sheet 1 is wound. According to the present embodiment, when the sheet 1 is wound in the outward winding manner, the arm member 4 does not come into contact with the roll sheet R formed by winding the sheet 1. The reason is that there is a risk that the formed image is affected by contact between the arm member 4 and the printed surface.

Subsequently, at S1314, the CPU 201 causes the cutter 20 to cut the sheet 1 when the rear edge portion of the region of the sheet 1 in which the image is formed is conveyed to the position of the cutter 20. The CPU 201 causes the lower spool member 2 to further rotate in the direction of C2 to wind the printed sheet 1 around the lower paper tube 27 until the entire sheet is wound. Subsequently, the process is finished.

According to the embodiment, the sheet 1 the front surface of which is printed can be wound around the paper tube 27.

The printing process in the one-side winding printing mode is not limited to the above embodiment.

For example, according to the above embodiment, the margin having the predetermined length L1 is left between the front edge of the sheet 1 and the region of the sheet 1 in which the image is formed. The present disclosure, however, is not limited thereto. For example, the margin is not left between the front edge of the sheet 1 and the region of the sheet 1 in which the image is formed, or only a small margin is left as in the printing process in the one-side printing mode. In this case, a user secures the front edge of the sheet 1 to the paper tube 27 after the region of the sheet 1 having the predetermined length L1 is printed.

According to the above embodiment, the winding method to be used is automatically determined in accordance with the result of the process of detecting inward winding. The present disclosure, however, is not limited thereto. For example, the CPU 201 may accept an input representing which winding method is used from a user as an operation on the operation panel 28 or a switch button, not illustrated, and the sheet 1 may be wound by the winding method corresponding to the accepted input. For example, in the case where the CPU 201 accepts the input representing which winding method is used from a user, the predetermined length L1 of the margin to be left on the sheet 1 may be changed in accordance with the winding method to be used before print. Specifically, the predetermined length L1 in the case of using the inward winding manner may be larger than the predetermined length L1 in the case of using the outward winding manner.

The CPU 201 may perform both of the processes of detecting inward winding and accepting the instruction of which winding method is to be used. In this case, the CPU 201 causes the sheet 1 to be wound in the instructed winding method only when the instructed winding method is the same as the winding method determined by the process of detecting inward winding. When the instructed winding method differs from the winding method determined by the process of detecting inward winding, the CPU 201 causes the operation panel 28 to display an error screen representing this, and the sheet is neither printed nor wound unless the winding methods are the same.

Description of Print in Duplex Printing Mode

Figure 14:
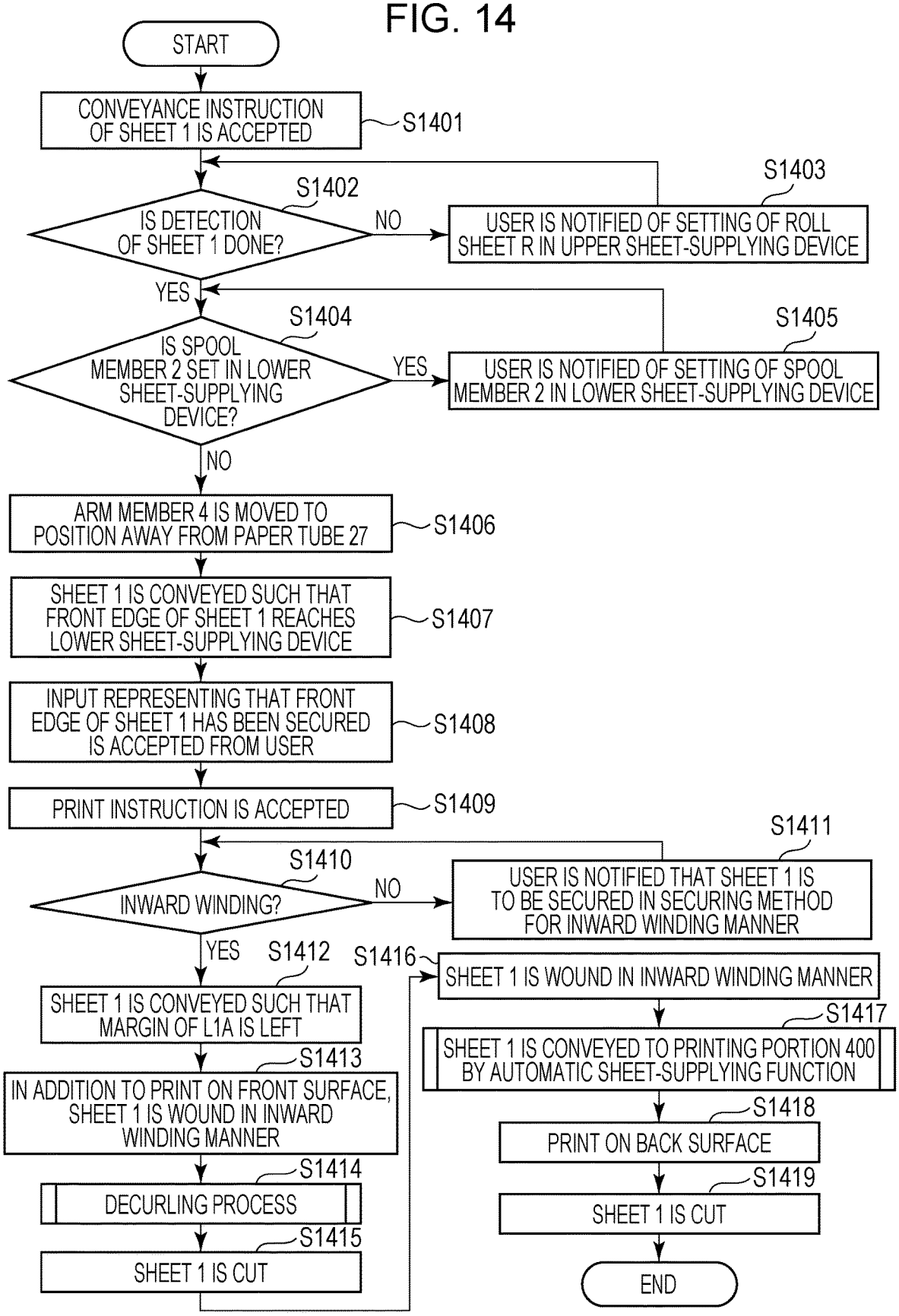
FIG. 14 is a flowchart illustrating a printing process that the printing apparatus performs in a "duplex printing mode".

FIG. 14 is a flowchart illustrating a printing process that the printing apparatus 100 performs in the "duplex printing mode". The process illustrated in the flowchart is performed in a manner in which the CPU 201 reads a program from the ROM 204 or an external storage, not illustrated, loads the program into the RAM 203, and runs the program. A user operation, for example, starts the process illustrated in the flowchart with the printing apparatus 100 in the "duplex printing mode". According to the present embodiment, the upper sheet-supplying device 200 serves as the supplying unit, and the lower sheet-supplying device 200 serves as the winding unit for printing.

Processes from S1401 to S1405 are the same as the processes from S1301 to S1305, and a description thereof is omitted.

Figure 17A:
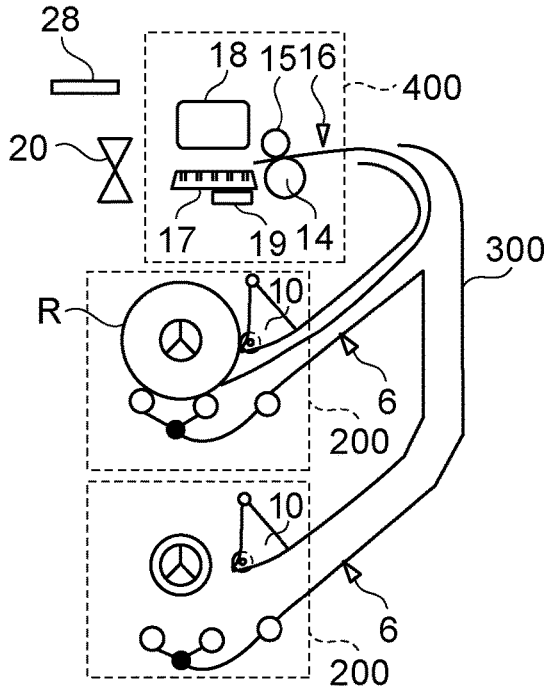
FIGS. 17A to 17D illustrate sectional views of the printing apparatus that is performing a printing process.

At S1406, the CPU 201 causes the arm member 4 to be moved to a position away from the paper tube 27 as in the process at S1306. FIG. 17A is a sectional view of the printing apparatus 100 in this state.

Figure 17B:
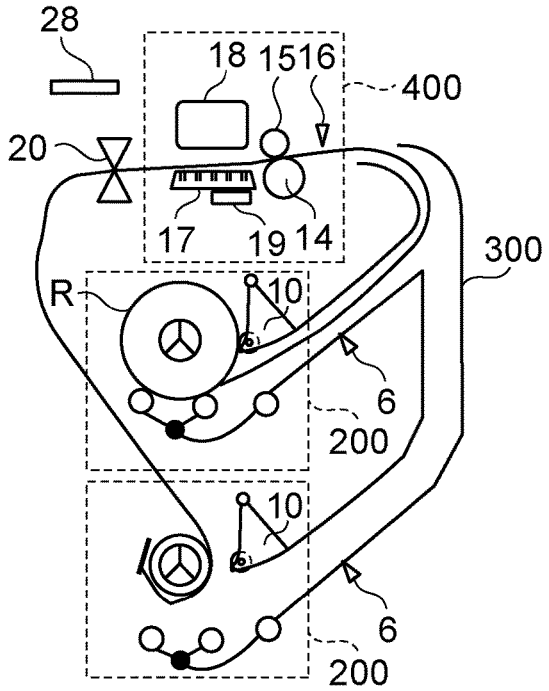

Subsequently, at S1407, the CPU 201 causes the sheet 1 to be further conveyed such that the front edge of the sheet 1 reaches the lower sheet-supplying device 200 before the printing portion 400 prints the sheet 1. According to the present embodiment, the CPU 201 needs to cause the sheet 1 to be wound around the paper tube 27 in the inward winding manner when the printing apparatus 100 is in the "duplex printing mode" for the reason described later. After the sheet 1 is thus conveyed, a user secures the front edge of the sheet 1 to the paper tube 27 set on the spool member 2 set in the lower sheet-supplying device 200 by the securing method for the inward winding manner (that is, the securing method illustrated in FIG. 11A). The securing method for the inward winding manner is illustrated in FIG. 11A. At this time, the CPU 201 may cause the operation panel 28 to display a screen to instruct the user to secure the front edge of the sheet 1 to the lower paper tube 27 by the securing method for the inward winding manner. FIG. 17B is a sectional view of the printing apparatus 100 with the sheet 1 secured to the lower paper tube 27 by the securing method for the inward winding manner.

Processes at S1408 and S1409 are the same as the processes at S1308 and S1309, and a description thereof is omitted.

According to the present embodiment, the CPU 201 performs duplex printing with the printing apparatus 100 in the "duplex printing mode". Duplex printing is a printing method in which the sheet 1 a surface (front surface) of which is printed is wound, and subsequently, the sheet 1 is supplied again to the printing portion 400 such that a surface (back surface) of the sheet 1 that is not printed faces the printing head 18 to print the back surface of the sheet 1. With the structure according to the present embodiment illustrated in FIG. 17D, the lower spool member 2 is rotated in the direction of C1 with the sheet 1 wound around the lower paper tube 27, and the wound sheet 1 is supplied again to the printing portion 400. According to the present embodiment, the CPU 201 causes the sheet 1 to be wound in the inward winding manner when the printing apparatus 100 is in the "duplex printing mode". In some cases, however, a user mistakenly secures the front edge of the sheet 1 to the spool member 2 set in the lower sheet-supplying device 200 by the securing method for the outward winding manner.

FIG. 15A illustrates the state of the sheet-supplying device 200 in the case where the sheet 1 is wound in the inward winding manner with the front edge of the sheet 1 secured to the lower paper tube 27 by the securing method for the outward winding manner by using the tape 51. The securing method for the outward winding manner is illustrated in FIG. 11B. According to the present embodiment, the CPU 201 causes the lower spool member 2 to rotate in the direction of C2 to wind the sheet 1 around the lower paper tube 27 in the inward winding manner. However, when the spool member 2 rotates in the direction of C2 with the front edge of the sheet 1 secured to the paper tube 27 by the securing method for the outward winding manner, a force to detach the tape 51 from the paper tube 27 is applied to the tape 51. Accordingly, there is a problem in that the tape 51 is detached from the paper tube 27 when the spool member 2 rotates as above such that the state of the tape 51 changes to a state 51*a* and a state 51*b* illustrated in FIG. 15A by dotted lines. In the case where the sheet 1 is wound in the outward winding manner because the securing method for the outward winding manner is used, there is a problem in that the sheet 1 is not successfully guided to the supply path even through the spool member 2 is rotated, and the sheet 1 is not appropriately supplied to the printing portion.

According to the present embodiment, at S1410, the CPU 201 performs the process of detecting inward winding to reduce the occurrence of the above problems. The detail of the process of detecting inward winding is the same as in the description related to the printing process in the one-side winding printing mode. When the decision in the process of detecting inward winding is YES, the CPU 201 performs a process at S1412. When the decision in the process of detecting inward winding is NO, the CPU 201 performs a process at S1411.

Figure 22:
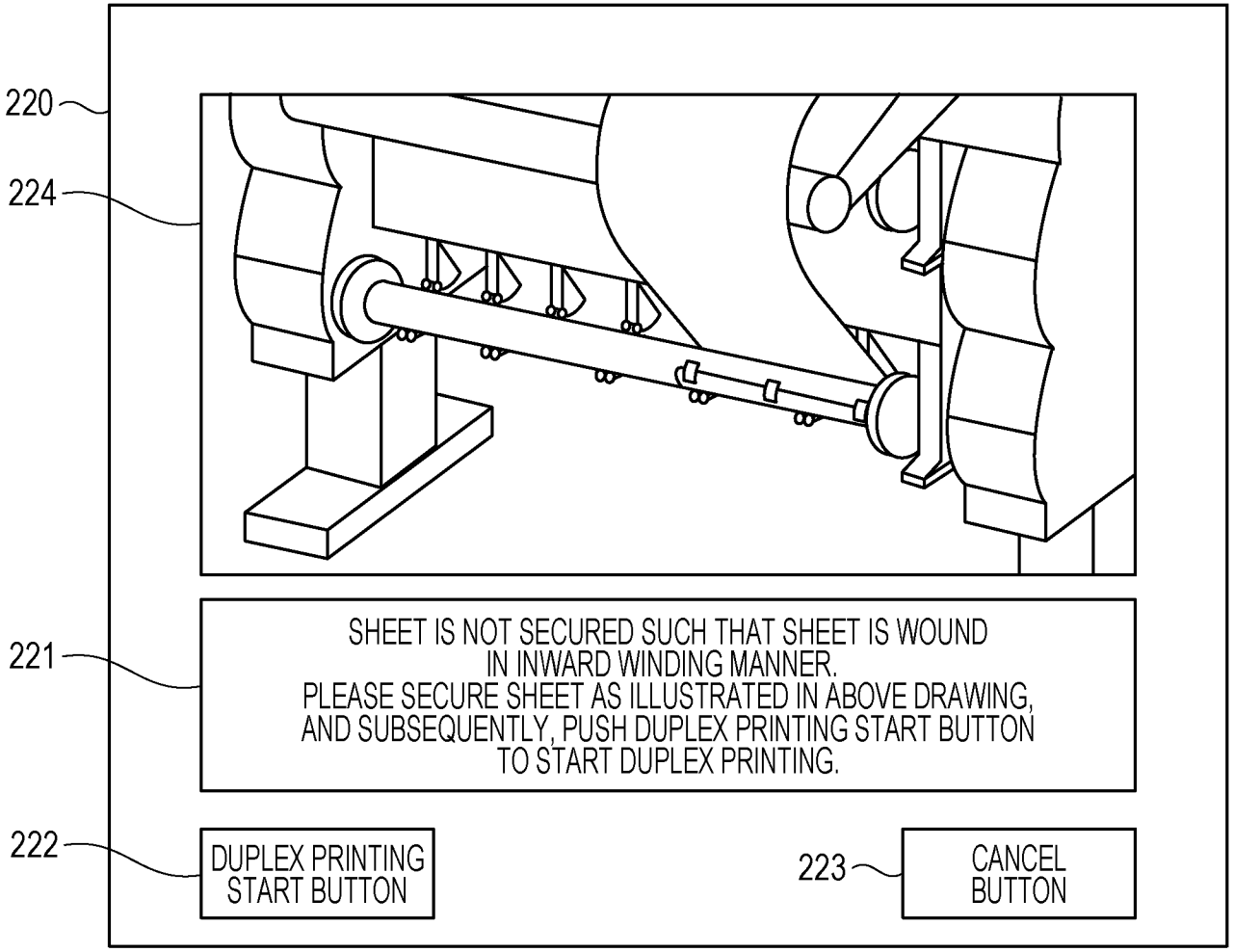
FIG. 22 illustrates an example of a screen that the printing apparatus displays.

At S1411, the CPU 201 instructs a user to secure the front edge of the sheet 1 to the lower paper tube 27 by the securing method for the inward winding manner. Specifically, the CPU 201 causes the operation panel 28 to display a screen (screen illustrated in FIG. 22) to instruct the user to secure the front edge of the sheet 1 to the lower paper tube 27 by the securing method for the inward winding manner. Subsequently, the CPU 201 performs the process at S1410. In FIG. 22, an instruction screen 220 includes, for example, regions 221 to 224. The region 221 is a region in which a message to instruct a user to secure the front edge of the sheet 1 to the lower paper tube 27 by the securing method for the inward winding manner is displayed. The region 222 is a region for accepting an input from a user in the case where the front edge of the sheet 1 is secured by the securing method for the inward winding manner. The CPU 201 performs the process at S1410 in the case where the input into the region 222 is accepted from a user. The region 223 is a region for accepting an input to cancel duplex printing from a user. The CPU 201 finishes the process without performing duplex printing in the case where the input into the region 223 is accepted from a user. The region 224 is a region in which the securing method for the inward winding manner is illustrated.

At S1412, the CPU 201 causes the sheet 1 to be further conveyed and a part of the sheet 1 to be wound around the spool member 2 before the printing portion 400 prints the sheet 1.

The process at S1412 will be described in detail. According to the present embodiment, the front edge of the sheet 1 is secured to the lower paper tube 27 by using the tape 51 to wind the sheet 1. During print on the back surface, the sheet 1 moves in the direction opposite the direction during print on the front surface, and the rear edge of the sheet 1 is secured to the lower paper tube 27.

According to the present embodiment, the sheet 1 is supplied to the printing portion 400 with the rear edge of the sheet 1 secured. According to the embodiment, there is a problem in that a region of the sheet 1 that has a predetermined length LP from the rear edge is not conveyed to the printing portion 400, and is not printed by the printing portion 400. The predetermined length LP is a length from the position of the spool member 2 to the position of the printing portion 400 on the conveyance route on which the sheet 1 is conveyed from the spool member 2 set in the lower sheet-supplying device 200. According to the present embodiment, duplex printing is finished when the cutter 20 cuts the rear edge portion of the region of the sheet 1 that is duplex printed. There is a problem in that the region of the sheet 1 that has a predetermined length LC from the rear edge is not conveyed to the cutter 20 and is not cut by the cutter 20 while the rear edge of the sheet 1 is secured. The predetermined length LC is a length from the position of the spool member 2 to the position of the cutter 20 on the conveyance route on which the sheet 1 is conveyed from the spool member 2 set in the lower sheet-supplying device 200.

According to the present embodiment, in consideration for the region of the sheet 1 that is neither printed nor cut while the rear edge is secured, the rear edge portion of the printed region of the sheet 1 is conveyed to the position of the cutter 20 and the printing portion 400. For this reason, at S1412, the sheet 1 is further conveyed such that the length from the front edge of the sheet 1 to the front edge of the region of the sheet 1 in which the image is formed becomes the length L2 or more. That is, a margin having the length L2 or more is left between the front edge of the sheet 1 and the region of the sheet 1 in which the image is formed. In the case where the position of the printing portion 400 is located upstream of the position of the cutter 20 on the conveyance route on which the sheet 1 is conveyed from the spool member 2 set in the lower sheet-supplying device 200, the length L2 is a length from the position of the spool member 2 to the position of the cutter 20 on the conveyance route. In the case where the position of the cutter 20 is located upstream of the printing portion 400 on the conveyance route on which the sheet 1 is conveyed from the spool member 2 set in the lower sheet-supplying device 200, the length L2 is a length from the position of the spool member 2 to the position of the printing portion 400 on the conveyance route.

When the sheet 1 is forcefully conveyed during print on the back surface to detach the rear edge of the sheet 1 from the lower paper tube 27, the sheet 1 may be broken, or the sheet 1 may be printed in a state where the tape 51 detached from the lower paper tube 27 adheres to the sheet 1.

Accordingly, it is preferable that the rear edge of the sheet 1 be not detached from the lower paper tube 27 until duplex printing is finished to reduce the occurrence of the above problems. According to the present embodiment, duplex printing is finished when the cutter 20 cuts the rear edge portion of the region of the sheet 1 that is duplex printed. That is, it is preferable that the cutter 20 cut the rear edge portion of the region of the sheet 1 that is duplex printed in a state where the rear edge of the sheet 1 is not detached from the lower paper tube 27.

In view of this, a margin of the length L2 or more is left between the rear edge of the sheet 1 and the rear edge of the region of the sheet 1 that is duplex printed so that the rear edge portion of the region of the sheet 1 that is duplex printed reaches the cutter 20 in a state where the rear edge of the sheet 1 is not detached from the lower paper tube 27. That is, according to the present embodiment, the front surface is printed at least with the margin having the length L2 or more left on the sheet. The length L2 is a length from the position of the spool member 2 to the position of the cutter 20 on the conveyance route on which the sheet 1 is conveyed from the spool member 2 set in the lower sheet-supplying device 200.

Figure 18:
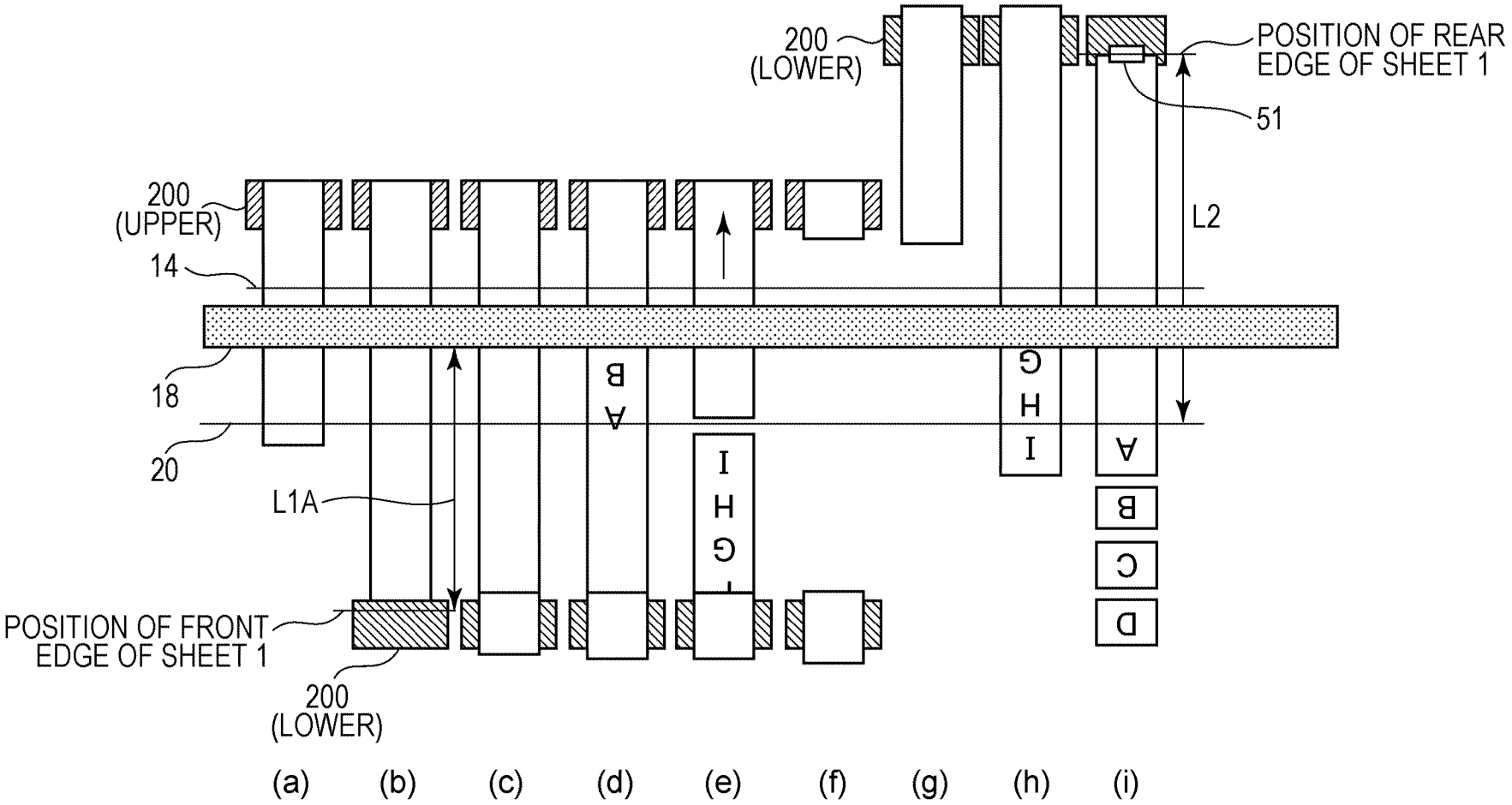
FIG. 18 schematically illustrates a conveyance route on which the sheet is conveyed from the spool member set in an upper sheet-supplying device by using straight lines.

FIG. 18 at (a) to (f) schematically illustrates the conveyance route on which the sheet 1 is conveyed from the spool member 2 set in the upper sheet-supplying device 200 (conveyance route for print on the front surface of the sheet 1) by using straight lines. FIG. 18 at (g) to (i) schematically illustrates the conveyance route on which the sheet 1 is conveyed from the spool member 2 set in the lower sheet-supplying device 200 (conveyance route for print on the back surface of the sheet 1) by using the straight lines.

The sheet 1 is first pulled out of the upper sheet-supplying device 200 as illustrated in FIG. 18 at (a). After this state, the sheet 1 is secured to the lower paper tube 27 by using the tape 51 as illustrated in FIG. 18 at (b) (S1407). At this time, the sheet 1 is conveyed such that a margin having at least a length of L1A is left thereon. A length of L1A is a length from the printing head 18 to the position of the spool member 2 set in the lower sheet-supplying device 200 on the conveyance route on which the sheet 1 is conveyed from the spool member 2 set in the upper sheet-supplying device 200.

Accordingly, at S1412, the CPU 201 causes the sheet 1 having a length of L1B or more that corresponds to L2-L1A to be further conveyed before the sheet 1 is printed as illustrated in FIG. 18 at (c) to leave the margin having a length of L2 or more on the sheet. According to the present embodiment, duplex printing needs at least the sheet 1 having a length of L2 or more, and accordingly, L2, L1A, L1B, and the residue L3 of the roll sheet R set in the upper sheet-supplying device 200 need to satisfy the following relationship:

$$L2 \leq L1A + L1B < L3.$$

The residue L3 of the roll sheet R set in the upper sheet-supplying device 200 can be detected, and accordingly, the CPU 201 causes the operation panel 28 or another component to display, for example, a warning screen and stops the operation when the CPU 201 decides that the above values do not satisfy the above relationship. The values of L1A, L1B, and L2 are determined by using the length of the conveyance route, and may differ between products. Accordingly, the values are stored in, for example, a memory, not illustrated, in the main body in advance, and, if needed, are read and used for the above decision. It is not necessary for the CPU 201 to cause the sheet 1 to be further conveyed at S1412 provided that the structure of the printing apparatus 100 is such that the margin L1A satisfies L1A>L2. Provided that the structure of the printing apparatus 100 is such that the margin L1A satisfies L1A<L2, the magnitude relationship between the margins left on the front edge of the sheet 1 in the modes is given as:

the margin in the "one-side printing mode"≤the margin in the "one-side winding printing mode"<the margin in the "duplex printing mode".

Figure 17C:
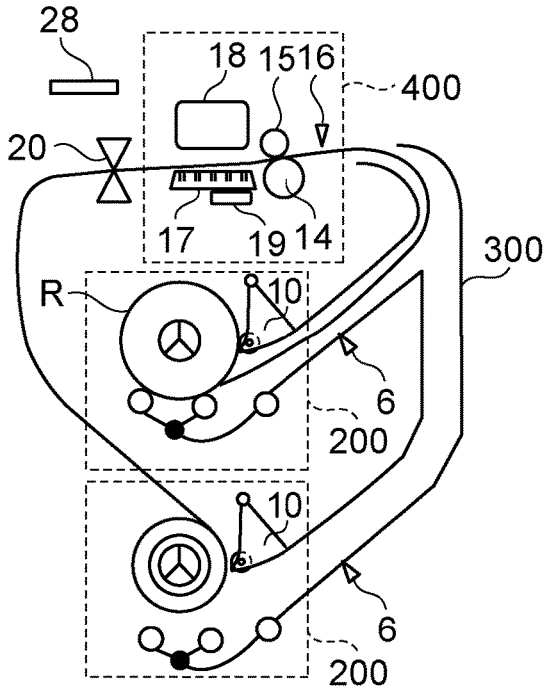

Subsequently, at S1413, the CPU 201 causes the printing head 18 to be scanned by using a carriage to form the image based on the print instruction in the region of the front surface that the sheet 1 conveyed to the printing portion 400 has and that faces the printing head 18. At this time, the printing process is started with the sheet 1 conveyed in the above manner, and accordingly, the margin having about L2 is left between the front edge of the sheet 1 and the region of the sheet 1 in which the image is formed. In the case where the print instruction indicates that images are to be formed, the CPU 201 causes the images to be continuously formed on the sheet 1, and the cutter 20 does not cut the sheet 1. Accordingly, as printing progresses, the state of the sheet 1 on the conveyance route becomes a state illustrated in FIG. 18 at (d). The sheet 1 that has been conveyed by the conveyance roller 14 and that has been one-side printed can be wound around the spool member 2 in a manner in which the spool member 2 set in the lower sheet-supplying device 200 is rotated for printing. A torque used for driving the roll-driving motor 33 is determined to be sufficiently less than a torque used for driving the conveyance-roller-driving motor 35. Accordingly, the accuracy of conveyance of the sheet 1 by using the conveyance roller 14 is not affected even when the sheet 1 is conveyed by the conveyance roller 14 at the same time as the sheet 1 is wound around the spool member 2. FIG. 17C is a sectional view of the printing apparatus 100 that is printing.

Figure 19A:
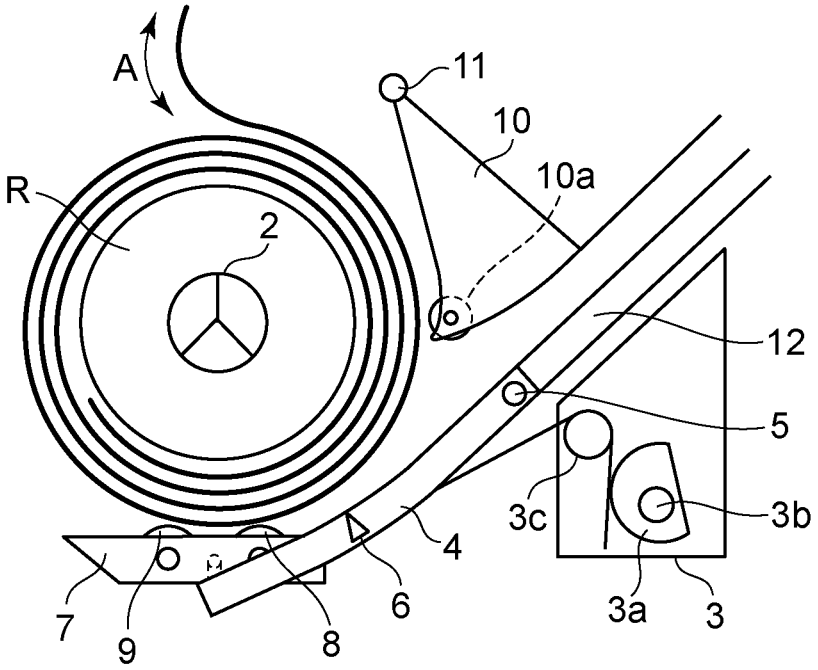
FIGS. 19A and 19B illustrate a decurling process.
Figure 19B:
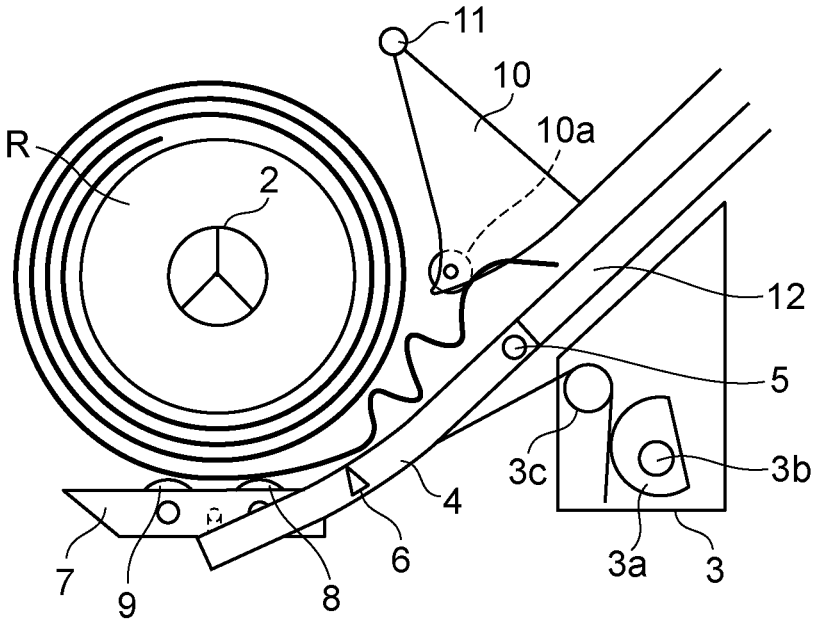

Subsequently, at S1414, the CPU 201 performs a decurling process. The decurling process smoothes curl of the sheet 1 pulled out of each roll sheet R. FIG. 19A illustrates the state of the lower sheet-supplying device 200 in the case where the sheet 1 is cut without the decurling process and wound around one of the spool members 2. In the case where the decurling process is not performed, curl of the rear edge portion of the sheet 1 pulled out of the roll sheet R illustrated by an arrow A remains. When the sheet 1 is supplied up to the supply path for duplex printing in this state, the curved sheet 1 having the curl hits against the separation flapper 10, the arm member 4, or another component, and as illustrated in FIG. 19B, there is a risk that the sheet 1 catches on the supply path. According to the present embodiment, the decurling process is performed to solve this problem.

The decurling process will be described in detail with reference to FIGS. 20A to 20D and FIG. 21. FIG. 21 is a flowchart illustrating the decurling process that the printing apparatus 100 performs. The process illustrated in the flowchart is performed in a manner in which the CPU 201 reads a program from the ROM 204 or an external storage, not illustrated, loads the program into the RAM 203, and runs the program. The process illustrated in the flowchart corresponds to the process at S1414 in FIG. 14. The process illustrated in the flowchart starts when the printing head 18 has printed a surface of the sheet 1.

Figure 20A:
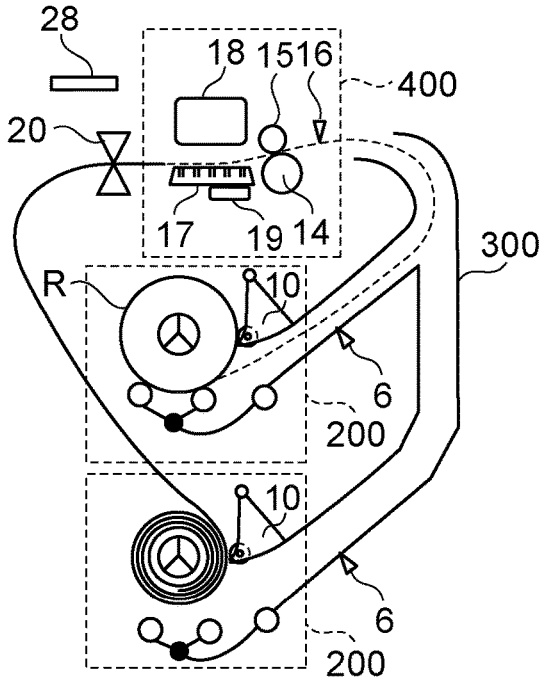
FIGS. 20A to 20D illustrate sectional views of the printing apparatus that is performing the decurling process.

FIG. 20A illustrates the state of the printing apparatus 100 when one-side printing is finished. In FIGS. 20A to 20D, a part of the sheet 1 that is pulled out of one of the roll sheets R and that is printed is illustrated by a solid line and the other part of the sheet 1 that is not printed is illustrated by a dashed line.

Figure 20B:
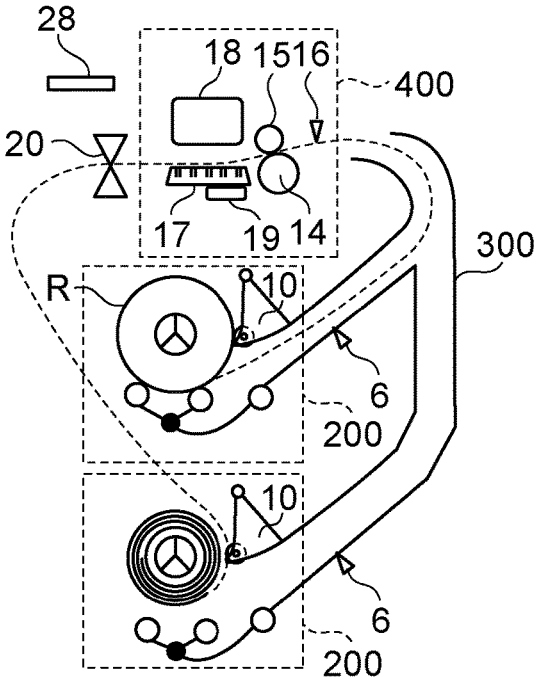
Figure 21:
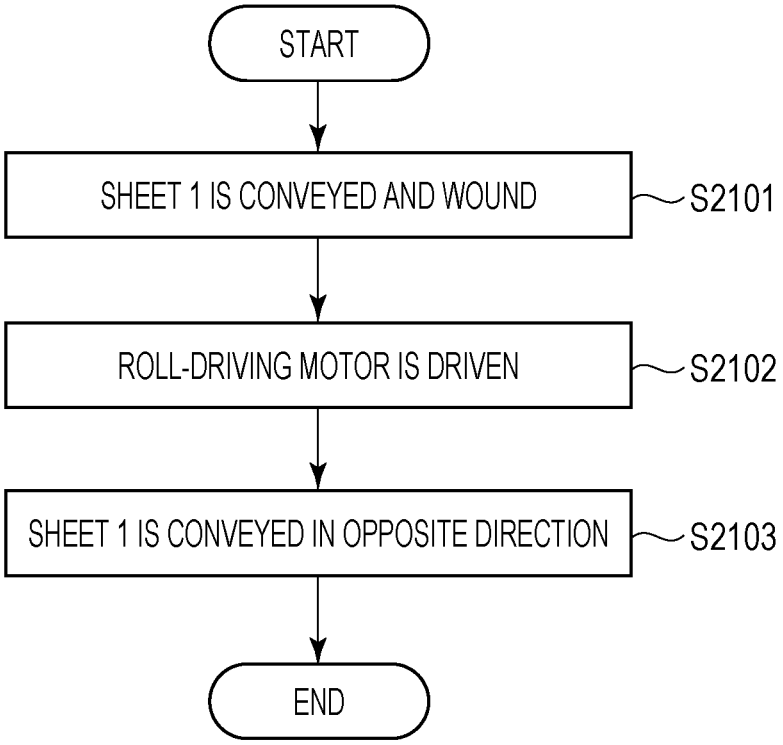
FIG. 21 is a flowchart illustrating the decurling process that the printing apparatus performs.

At S2101, the CPU 201 causes the conveyance roller 14 to convey the sheet 1 and causes the lower sheet-supplying device 200 to wind the sheet 1 until the sheet 1 is wound into a roll shape up to the rear edge portion of the printed region of the sheet 1. FIG. 20B illustrates the state of the printing apparatus 100 at this time.

Figure 20C:
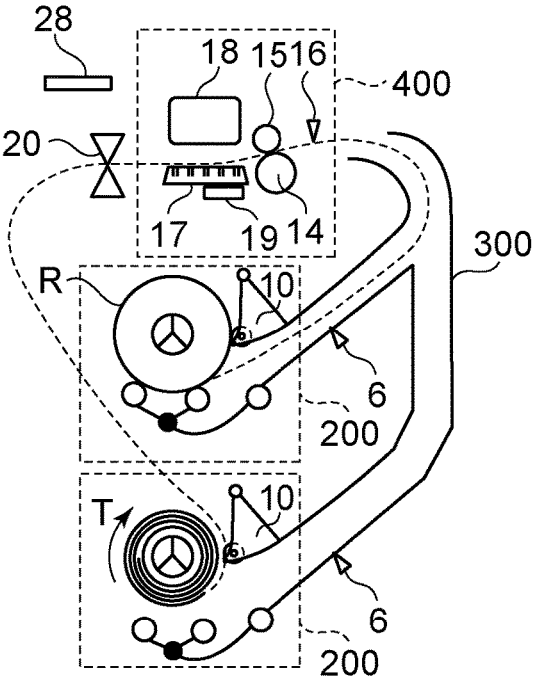

Subsequently, at S2102, the CPU 201 causes the roll-driving motor 33 to be driven to rotate the spool member 2 set in the lower sheet-supplying device 200 in the direction of T in the figure in a state where conveyance of the sheet 1 by using the conveyance roller 14 is stopped. FIG. 20C illustrates the state of the printing apparatus 100 at this time. At this time, since conveyance of the sheet 1 by using the conveyance roller 14 is stopped, the spool member 2 does not substantially rotate. However, a rotational force in the direction of T in the figure is applied to the spool member, and a tension is applied to the sheet 1 wound around the spool member 2. This straightens the curl of the sheet 1 in the direction of the arrow A so as to follow the curl of the roll formed in the lower sheet-supplying device 200, and accordingly, the curl of the sheet 1 in the direction of the arrow A is smoothed.

Figure 20D:
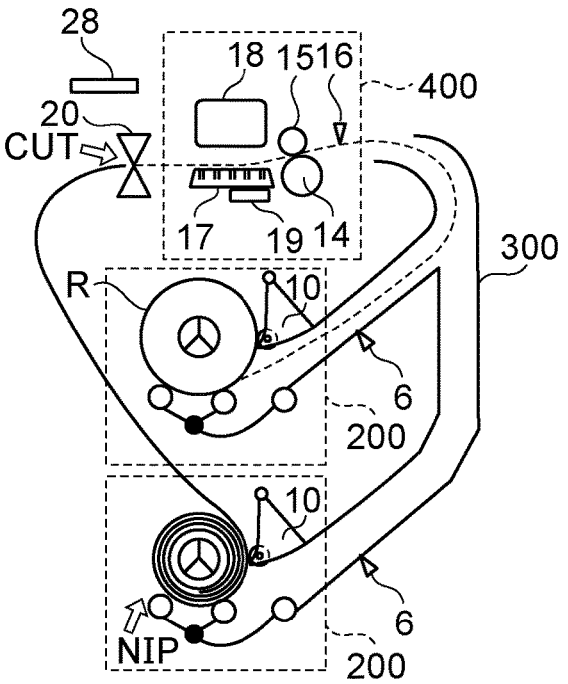

Subsequently, at S2103, the CPU 201 causes the sheet 1 to be conveyed in the opposite direction (back feed) until the rear edge portion of the printed region of the sheet 1 moves to the position of the cutter 20, as illustrated in FIG. 20D. At this time, to prevent the roll formed in the lower sheet-supplying device 200 from being unwound, the roll is pressed by the corresponding arm member 4.

The possibility of the sheet 1 catching on the supply path can be reduced in a manner in which the decurling process is thus performed before the sheet 1 that has been one-side printed is supplied again to the printing portion 400.

The harder the sheet 1, the greater the degree of the curl of the sheet 1. In view of this, parameters used in the decurling process may be changed in accordance with the stiffness and type of the sheet 1. For example, when the stiffness of the sheet 1 is high, the driving force of the roll-driving motor 33 is increased, and the tension applied to the sheet 1 at S2102 is increased. For example, the time during which the tension is applied to the sheet 1 at S2102 is increased. In contrast, for example, when the stiffness of the sheet 1 is low, the driving force of the roll-driving motor 33 is decreased, and the tension applied to the sheet 1 at S2102 is decreased. For example, the time during which the tension is applied to the sheet 1 at S2102 is decreased. For example, the decurling process itself is omitted.

The smaller the diameter of the roll sheet R out of which the sheet 1 is pulled, the greater the degree of the curl of the sheet 1. The CPU 201 enables the diameter of the roll sheet R to be calculated by using a rotary encoder included in each sheet-supplying device 200. Accordingly, in the case where the diameter of the roll sheet R is small, the driving force of the roll-driving motor 33 is increased, and the tension applied to the sheet 1 at S2102 is increased. For example, the time during which the tension is applied to the sheet 1 at S2102 is increased. In contrast, for example, in the case where the diameter of the roll sheet R is large, the driving force of the roll-driving motor 33 is decreased, and the tension applied to the sheet 1 at S2102 is decreased. For example, the time during which the tension is applied to the sheet 1 at S2102 is decreased. For example, the decurling process itself is omitted.

During print in the one-side printing mode or the one-side winding printing mode, the sheet 1 is not supplied up to the supply path for duplex printing, and accordingly, it is not necessary for the decurling process to be performed. For this reason, according to the present embodiment, the decurling process is performed in the duplex printing mode only. According to the embodiment, print in the one-side printing mode and print in the one-side winding printing mode can be quickly finished by omitting the decurling process.

The decurling process is not limited to the above embodiment and may be any process to smooth the curl of the sheet 1 such as a process of using a roller for decurling. The timing with which the decurling process is performed is not limited to the above embodiment. It is only necessary for the decurling process to be performed at least before the sheet 1 that has been one-side printed is supplied again to the printing portion 400. For example, the decurling process may be performed before the sheet 1 is wound or after the sheet 1 is wound. However, according to the embodiment described above, the decurling process can be performed with the structure needed for duplex printing.

Subsequently, at S1415, the CPU 201 causes the cutter 20 to cut the sheet 1 as illustrated in FIG. 18 at (e), when the rear edge portion of the region of the sheet 1 in which the image is formed is conveyed in the opposite direction to the position of the cutter 20.

Subsequently, at S1416, the CPU 201 causes the corresponding spool member 2 to rotate after the sheet 1 is cut to wind the sheet 1 on which the image is formed around the lower paper tube 27 in the inward winding manner until the entire sheet is wound as illustrated in FIG. 18 (*f*). The CPU 201 causes the upper spool member 2 to rotate in the winding direction to retract the sheet 1 pulled out of the upper roll sheet R.

Figure 17D:
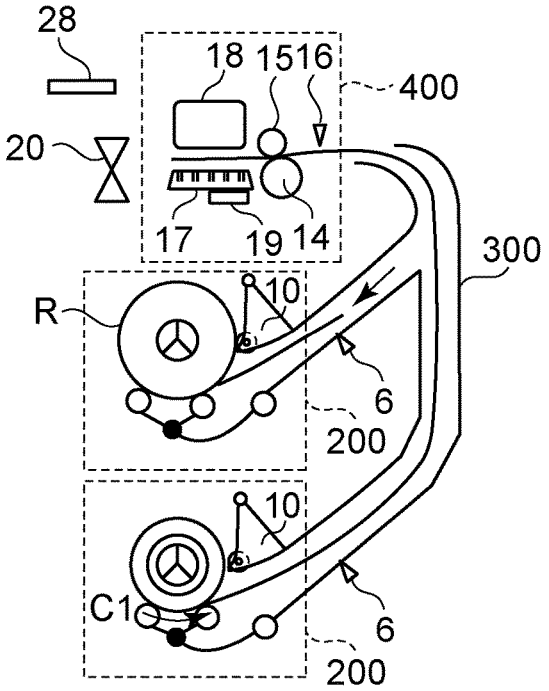

Subsequently, at S1417, the CPU 201 causes the sheet 1 wound around the spool member 2 set in the lower sheet-supplying device 200 to be conveyed again to the printing portion 400 for duplex printing. According to the present embodiment, the sheet 1 is conveyed again to the printing portion 400 by the automatic sheet-supplying function. This enables duplex printing to be performed even when a user does not guide the sheet 1 to the supply path after one-side printing. At S1417, the CPU 201 performs the processes illustrated in FIG. 6 to convey the sheet 1 again to the printing portion 400 by the automatic sheet-supplying function. At this time, the CPU 201 causes the separation flapper 10 to come into contact with the paper tube 27. The reason is that the sheet 1 can be guided to the supply path when the sheet 1 is supplied again to the printing portion 400 for duplex printing in a manner in which the separation flapper 10 comes into contact with the paper tube 27. FIG. 17D is a sectional view of the printing apparatus 100 in a state where the sheet 1 pulled out of the upper roll sheet R is retracted, and the sheet 1 is conveyed again to the printing portion 400. FIG. 18 at (g) illustrates the state of the sheet 1 that is being conveyed again on the conveyance route.

Subsequently, at S1418, the CPU 201 causes the printing head 18 to form the image based on the print instruction in the region of the back surface that the sheet 1 conveyed to the printing portion 400 has and that faces the printing head 18. Since duplex printing is performed at this time, the region opposite the printed region of one of the surfaces of the sheet 1 is printed. The margin having about L2 is left on the rear edge portion of the sheet 1 by the process at S1412. Accordingly, the rear edge of the region opposite the printed region of the one of the surfaces of the sheet 1 reaches the printing portion 400 even in a state where the rear edge of the sheet 1 is secured to the spool member 2 by using the tape 51. FIG. 18 at (h) illustrates the state of the sheet 1 the back surface of which is being printed.

Subsequently, the CPU 201 causes the cutter 20 to cut the sheet 1 when the rear edge portion of the region of the sheet 1 in which the image is formed is conveyed to the position of the cutter 20. Thus, the sheet 1 on which the image is formed falls down by own weight and is accommodated in the basket 62. At this time, the sheet 1 is cut for every image. Accordingly, in the case where images are formed on the sheet 1, the sheet 1 is cut multiple times as illustrated in FIG. 18 at (i). The printing head 18 may print a next image at the same time as the sheet 1 is cut.

For example, in the case where the number of the sheet-supplying devices 200 are three or more, or in the case where the roll is removed from the upper sheet-supplying device 200 after one-side printing, and the paper tube is set therein instead, the sheet 1 that has been duplex printed may be wound.

This enables the printing apparatus according to the present embodiment to perform not only one-side printing on the roll sheet but also duplex printing on the roll sheet.

Other Embodiment

Figure 23A:
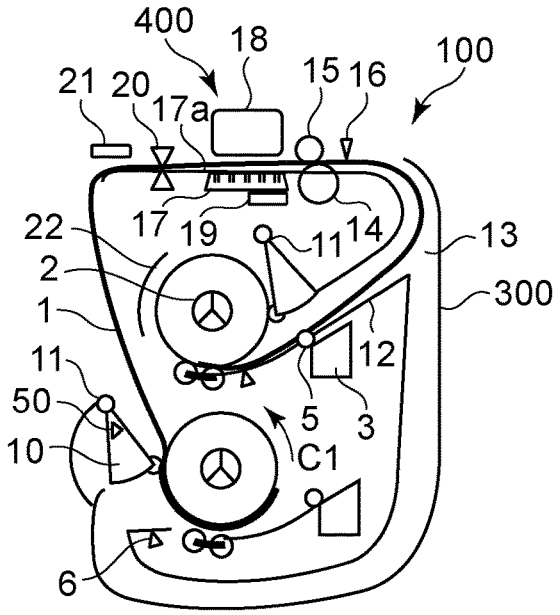
FIGS. 23A to 23D illustrate an example of a printing apparatus that winds the sheet in the outward winding manner to perform duplex printing.
Figure 23B:
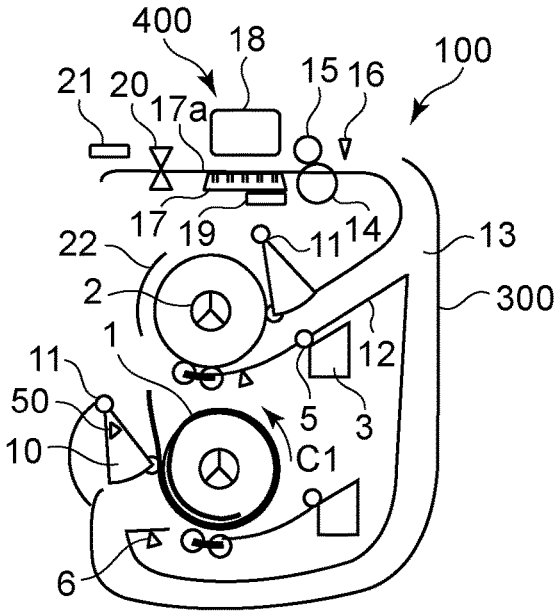
Figure 23C:
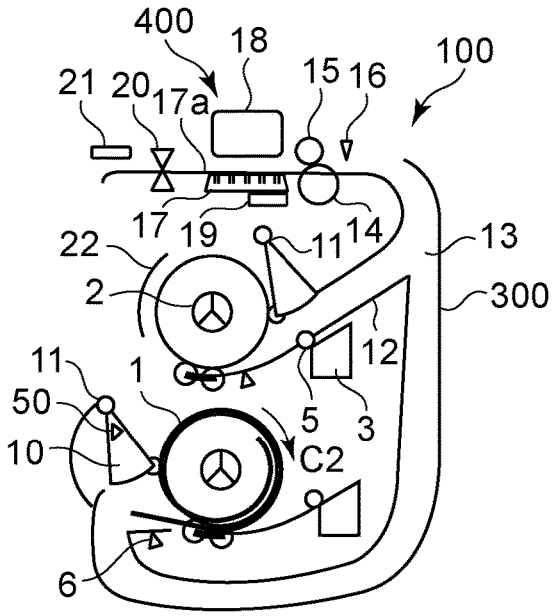
Figure 23D:
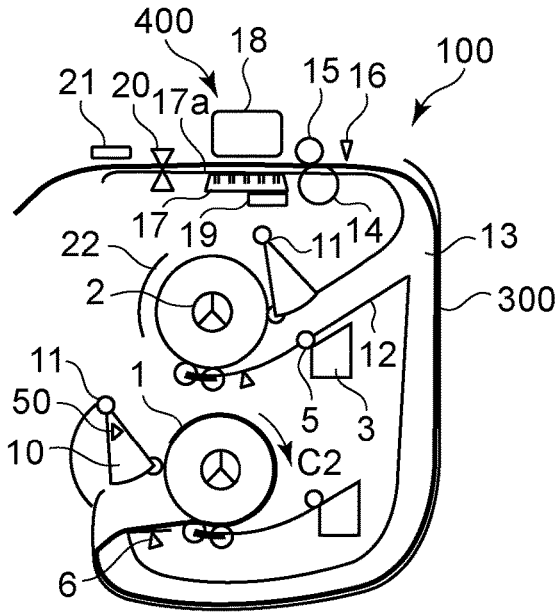

According to the embodiment described above, when the printing apparatus 100 is in the "duplex printing mode", the sheet 1 is wound in the inward winding manner. The present disclosure, however, is not limited thereto. The sheet 1 may be wound in the outward winding manner depending on the structure of the printing apparatus 100. FIGS. 23A to 23D illustrate an example of the printing apparatus 100 that winds the sheet 1 in the outward winding manner for duplex printing. According to an embodiment illustrated in FIGS. 23A to 23D, duplex printing is performed in a manner in which the sheet 1 is wound in the outward winding manner. FIG. 23A illustrates the printing apparatus 100 that is winding the sheet 1 around the lower paper tube 27 in the outward winding manner at the same time as one of the surfaces of the sheet 1 is printed. FIG. 23B illustrates the printing apparatus 100 that is winding the sheet 1 around the lower paper tube 27 in the outward winding manner after the one of the surfaces of the sheet 1 is printed. FIG. 23C illustrates the printing apparatus 100 that is guiding the front edge of the sheet 1 to the supply path by rotating the lower spool member 2 in the direction of C2 after detection of the front edge of the sheet 1 separated from the outer circumferential surface of one of the roll sheets R. FIG. 23D illustrates the printing apparatus 100 with the sheet 1 supplied again to the printing portion 400 on the supply path. According to the embodiment, in which the lower spool member 2 is thus rotated in the direction of C2 to supply the sheet 1 wound around the lower paper tube 27 again to the printing portion 400, duplex printing can be performed by winding the sheet 1 in the outward winding manner. Also according to the embodiment, the automatic sheet-supplying function can be achieved in the case where one of the sheet sensors 6 is disposed between the corresponding roll sheet R and the entrance (opening portion) of the supply path as illustrated in FIGS. 23A to 23D. As illustrated in FIGS. 23A to 23D, in the case where the inward-winding detecting sensor 50 is disposed at the same level as an upper portion of the roll sheet near the opening portion, it can be detected whether the method of securing the sheet 1 is the method for the inward winding manner. However, according to the embodiment, the process of error handling is performed when the method is detected to be the securing method for the inward winding manner, and duplex printing is normally performed when the method is detected to be the securing method for the outward winding manner.

According to the embodiments described above, the sheet 1 is pulled out of each roll sheet for printing. The present disclosure, however, is not limited thereto. For example, the printing apparatus may include a structure to supply a cut sheet on the back surface, and a recording medium supplied from the structure may be printed.

The present disclosure can be used for various sheet-supplying devices including a sheet-supplying device that supplies a sheet as a recording medium to the printing apparatus. For example, the present disclosure can be used for an apparatus that supplies a sheet to be read by a reading apparatus such as a scanner or a copying machine, and an apparatus that supplies a sheet-like material to a processing apparatus such as a cutting apparatus. Such a sheet-supplying device can be separated from the printing apparatus, the reading apparatus, the processing apparatus, and another apparatus and may include a control unit (CPU) for the sheet-supplying device.

The above embodiments can be carried out also in the case where programs that achieve the functions according to the above embodiments are supplied to a system or an apparatus via a network or a storage medium and processors of a computer of the system or the apparatus perform the programs. The above embodiments can be carried out also by using a circuit (for example, ASIC) having the functions.

Embodiment(s) can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the details have been described with reference to exemplary embodiments, it is to be understood that the details are not limited to the disclosed exemplary embodiments. The scope of the following claims is to be accorded the broadest interpretation so as to encompass all such modifications and equivalent structures and functions.

This application claims the benefit of Japanese Patent Application No. 2017-046421, filed Mar. 10, 2017, No. 2017-046422, filed Mar. 10, 2017, No. 2017-046423, filed Mar. 10, 2017, and No. 2017-046424, filed Mar. 10, 2017, which are hereby incorporated by reference herein in their entirety.

What is claimed is:

1. A printing apparatus comprising:

a printing unit configured to print to a first surface of a recording medium and a second surface of the recording medium opposite the first surface;

a conveyance unit configured to convey the recording medium by using a conveyance roller;

a first supplying unit configured to supply the recording medium to the printing unit by conveying the recording medium by using the conveyance roller;

a second supplying unit that is other than the first supplying unit and is configured to supply the recording medium to the printing unit; and at least one processor and a memory storing instructions that, when the instructions are executed by the at least one processor, cause the at least one processor to perform operations including:

performing control to control a winding member that is set in the second supplying unit, performing control, in a case where the recording medium is supplied from the first supplying unit, to cause the printing unit to print to the first surface of the recording medium supplied from the first supplying unit and to cause the second supplying unit to wind the recording medium, supplied from the first supplying unit and having the printed first surface, around the winding member by rotating the winding member, supplying, by the second supplying unit rotating the winding member, the recording medium wound around the winding member to the printing unit through an opening portion of a conveyance route on which the recording medium wound around the winding member passes when the recording medium is supplied to the printing unit, printing, by the printing unit, to the second surface of the recording medium supplied from the second supplying unit to the printing unit after the recording medium is wound around the winding member, and causing, before supplying the recording medium wound around the winding member to the opening portion by rotating the winding member, a decurling process to be performed by performing control to rotate the winding member in a state (i) in which a part of the recording medium supplied from the first supplying unit is wound around the winding member without being cut between the first supplying unit and the second supplying unit and (ii) in which conveyance of the recording medium supplied from the first supplying unit by using the conveyance roller is stopped.

2. The printing apparatus according to claim 1, wherein the performed operations further include:

detecting an edge of the recording medium set in the first supplying unit, wherein a medium winding member is set in the first supplying unit, performing control, in a case where the edge is detected, to control a position of the edge of the recording medium set in the first supplying unit such that the edge is located at a predetermined location, for guiding the edge to a predetermined opening portion of a conveyance route on which the recording medium, set in the first supplying unit, passes when the recording medium is supplied to the printing unit, by rotating the medium winding member, guiding, in a case where a recording medium has a roll shape and is set in the first supplying unit is rotated, the edge of the recording medium, set in the first supplying unit, from the predetermined location to the predetermined opening portion, and supplying, by the first supplying unit, the recording medium, having the roll shape and is set in the first supplying unit, to the printing unit through the predetermined opening portion by rotating the recording medium, having the roll shape and is set in the first supplying unit, after the edge is controlled to be located at the predetermined location.

3. The printing apparatus according to claim 1, wherein, the performed operations further include:

before the printing unit forms an image on the first surface, (i) supplying the recording medium from the first supplying unit and (ii) conveying the supplied recording medium by the conveyance unit such that a margin having at least a predetermined length is left between a front edge of the supplied recording medium and a front edge of an image-to-be-formed region of the first surface of the supplied recording medium, winding the recording medium around the winding member after the front edge of the recording medium that is supplied from the first supplying unit and conveyed by the conveyance unit is secured to the winding member, and supplying the recording medium wound around the winding member to the printing unit through the conveyance route, and wherein the predetermined length is a length from a position corresponding to the winding member to a position corresponding to the printing unit on the conveyance route.

4. The printing apparatus according to claim 1, wherein the performed operations further include:

supplying, by the first supplying unit, the wound recording medium to the printing unit in a case where the recording medium having the printed first surface is wound around a winding member set in the first supplying unit, and supplying, by the first supplying unit, the set recording medium to the printing unit in a case where a recording medium that is wound in advance is set to the first supplying unit by a user.

5. The printing apparatus according to claim 1, wherein the printing unit discharges ink on the recording medium for printing.

6. The printing apparatus according to claim 1, wherein the performed operations further include:

detecting an edge of the recording medium that is separated from an outer circumferential surface of a roll of the recording medium that is formed by winding the recording medium around the winding member, performing control, based on detecting the edge, to control a position of the edge such that the edge is located at a specific location for guiding the edge to the opening portion of the conveyance route on which the recording medium wound around the winding member passes when the recording medium is supplied to the printing unit, by rotating the winding member, wherein, in a case where the winding member is rotated, the edge is guided from the specific location to the opening portion, and supplying, by the second supplying unit, the recording medium wound around the winding member to the printing unit through the opening portion by rotating the winding member after the edge is controlled to be located at the specific location.

7. The printing apparatus according to claim 6, wherein the specific location is between the opening portion and an outer circumferential surface of a roll of the recording medium that is formed by winding the recording medium around the winding member.

8. The printing apparatus according to claim 1, wherein the performed operations further include:

supplying the wound recording medium to the printing unit by the second supplying unit in a case where the recording medium, supplied by the first supplying unit and having the printed first surface, is wound around the winding member, and supplying the set recording medium to the printing unit by the second supplying unit in a case where a recording medium that is wound in advance is set to the second supplying unit by a user.

9. The printing apparatus according to claim 1, wherein the printing apparatus is configured to operate in any one of a plurality of states including (i) a first state in which, after the recording medium having the printed first surface is wound around the winding member, the second surface of the recording medium wound around the winding member is not printed, and (ii) a second state in which the first surface and the second surface of the recording medium are printed, printed, and wherein, in a case where the printing apparatus is in the first state, the decurling process is not performed, and wherein, in a case where the printing apparatus is in the second state, the decurling process is performed before supplying the recording medium wound around the winding member to the opening portion by rotating the winding member.

10. The printing apparatus according to claim 9, wherein the plurality of states further includes (iii) a third state in which, after the first surface of the recording medium is printed by the printing unit, the recording medium having the printed first surface is not wound around the winding member, and wherein, in a case where the printing apparatus is in the third state, the decurling process is not performed.

11. The printing apparatus according to claim 1, wherein, by rotating the winding member in a first direction, the second supplying unit winds the recording medium, supplied from the first supplying unit and having the printed first surface, around the winding member, and wherein, by rotating the winding member in a second direction opposite to the first direction, the second supplying unit supplies the recording medium wound around the winding member to the printing unit through the opening portion.

12. The printing apparatus according to claim 1, wherein the decurling process is configured to smooth curl of a sheet pulled out of each supplying unit, including the first supplying unit and the second supplying unit.

13. The printing apparatus according to claim 1, wherein, in a case where the decurling process is performed, curl is removed from a rear edge portion of a decurled sheet so that a risk of the decurled sheet catching on a supply path is reduced, and movement of the decurled sheet does not include the rear edge portion of the decurled sheet hitting a separation flapper or an arm member of the printing apparatus.

14. The printing apparatus according to claim 1, wherein, in a state where conveyance of the sheet by using a conveyance roller is stopped and the sheet is wound around a spool member, the decurling process is performed by rotating the spool member to apply a rotational force to the spool member that applies a tension to the sheet wound around the spool member.

15. The printing apparatus according to claim 14, wherein the rotational force to the spool member as part of the decurling process is based on a stiffness parameter of the sheet.

16. A printing apparatus comprising:

a printing unit configured to print to a first surface of a recording medium and a second surface of the recording medium opposite the first surface;

a first supplying unit configured to supply the recording medium to the printing unit;

a second supplying unit that is other than the first supplying unit and is configured to supply the recording medium to the printing unit, wherein a winding member is set in the second supplying unit; and at least one processor and a memory storing instructions that, when the instructions are executed by the at least one processor, cause the at least one processor to perform operations including:

determining whether or not a front edge of the recording medium is secured to the winding member by a predetermined securing method, wherein, in a state in which the front edge of the recording medium is secured to the winding member by the predetermined securing method, the winding member is configured to wind the recording medium around the winding member such that the first surface of the recording medium supplied from a first supplying portion is in contact with the winding member, and wherein, in a case where the recording medium is supplied from the first supplying unit, the printing unit prints to the first surface of the recording medium supplied from the first supplying unit and the second supplying unit winds the recording medium, supplied from the first supplying unit and having the printed first surface, around the winding member by rotating the winding member, supplying, by the second supplying unit rotating the winding member, the recording medium wound around the winding member to the printing unit through an opening portion of a conveyance route on which the recording medium wound around the winding member passes when the recording medium is supplied to the printing unit, printing, by the printing unit, to the second surface of the recording medium supplied from the second supplying unit to the printing unit after the recording medium is wound around the winding member, and performing control, in a case where it is determined that the front edge of the recording medium is secured to the winding member by the predetermined securing method, to control the winding member to wind the recording medium around the winding member such that the first surface of the recording medium supplied from the first supplying portion is in contact with the winding member.

17. The printing apparatus according to claim 16, wherein the performed operations further include:

detecting an edge of the recording medium set in the first supplying unit, wherein a medium winding member is set in the first supplying unit, performing control, in a case where the edge is detected, to control a position of the edge of the recording medium set in the first supplying unit such that the edge is located at a predetermined location, for guiding the edge to a predetermined opening portion of a conveyance route on which the recording medium, set in the first supplying unit, passes when the recording medium is supplied to the printing unit, by rotating the medium winding member, guiding, in a case where a recording medium has a roll shape and is set in the first supplying unit is rotated, the edge of the recording medium, set in the first supplying unit, from the predetermined location to the predetermined opening portion, and supplying, by the first supplying unit, the recording medium, having the roll shape and is set in the first supplying unit, to the printing unit through the predetermined opening portion by rotating the recording medium, having the roll shape and is set in the first supplying unit, after the edge is controlled to be located at the predetermined location.

18. The printing apparatus according to claim 16, further comprising a conveyance unit configured to convey the recording medium, wherein the performed operations further include:

before the printing unit forms an image on the first surface, (i) supplying the recording medium from the first supplying unit and (ii) conveying the supplied recording medium by the conveyance unit such that a margin having at least a predetermined length is left between a front edge of the supplied recording medium and a front edge of an image-to-be-formed region of the first surface of the supplied recording medium, winding the recording medium around the winding member after the front edge of the recording medium that is supplied from the first supplying unit and conveyed by the conveyance unit is secured to the winding member, and supplying the recording medium wound around the winding member to the printing unit through the conveyance route, and wherein the predetermined length is a length from a position corresponding to the winding member to a position corresponding to the printing unit on the conveyance route.

19. The printing apparatus according to claim 16, wherein the performed operations further include:

supplying, by the first supplying unit, the wound recording medium to the printing unit in a case where the recording medium having the printed first surface is wound around a winding member set in the first supplying unit, and supplying, by the first supplying unit, the set recording medium to the printing unit, in a case where a recording medium that is wound in advance is set to the first supplying unit by a user.

20. The printing apparatus according to claim 16, wherein the printing unit discharges ink on the recording medium for printing.

21. The printing apparatus according to claim 16, wherein the performed operations further include:

detecting an edge of the recording medium that is separated from an outer circumferential surface of a roll of the recording medium that is formed by winding the recording medium around the winding member, performing control, based on detecting the edge, to control a position of the edge such that the edge is located at a specific location for guiding the edge to the opening portion of the conveyance route on which the recording medium wound around the winding member passes when the recording medium is supplied to the printing unit, by rotating the winding member, wherein, in a case where the winding member is rotated, the edge is guided from the specific location to the opening portion, and supplying, by the second supplying unit, the recording medium wound around the winding member to the printing unit through the opening portion by rotating the winding member after the edge is controlled to be located at the specific location.

22. The printing apparatus according to claim 21, wherein the specific location is between the opening portion and an outer circumferential surface of a roll of the recording medium that is formed by winding the recording medium around the winding member.

23. The printing apparatus according to claim 16, wherein the performed operations further include:

supplying the wound recording medium to the printing unit by the second supplying unit in a case where the recording medium, supplied by the first supplying unit and having the printed first surface, is wound around the winding member, and supplying the set recording medium to the printing unit by the second supplying unit in a case where a recording medium that is wound in advance is set to the second supplying unit by a user.

24. The printing apparatus according to claim 16, wherein the performed operations further include performing control, in a case where it is determined that the front edge of the recording medium is not secured to the winding member by the predetermined securing method, to control the winding member not to wind the recording medium around the winding member.

25. The printing apparatus according to claim 16, wherein, by rotating the winding member in a first direction, the second supplying unit winds the recording medium, supplied from the first supplying unit and having the printed first surface, around the winding member, and wherein, by rotating the winding member in a second direction opposite to the first direction, the second supplying unit supplies the recording medium wound around the winding member to the printing unit through the opening portion.

26. A printing apparatus comprising:

a printing unit configured to print to a first surface of a recording medium and a second surface of the recording medium opposite the first surface;

a first supplying unit configured to supply the recording medium to the printing unit;

a second supplying unit that is other than the first supplying unit and is configured to supply the recording medium to the printing unit, wherein a winding member is set in the second supplying unit; and at least one processor and a memory storing instructions that, when the instructions are executed by the at least one processor, cause the at least one processor to perform operations including:

determining whether or not a front edge of the recording medium is secured to the winding member by a predetermined securing method, wherein, in a state in which the front edge of the recording medium is secured to the winding member by the predetermined securing method, the winding member is configured to wind the recording medium around the winding member such that the first surface of the recording medium supplied from a first supplying portion is in contact with the winding member, performing notification to a user by a notification unit, wherein, in a case where the recording medium is supplied from the first supplying unit, the printing unit prints to the first surface of the recording medium supplied from the first supplying unit and the second supplying unit winds the recording medium, supplied from the first supplying unit and having the printed first surface, around the winding member by rotating the winding member, supplying, by the second supplying unit rotating the winding member, the recording medium wound around the winding member to the printing unit through an opening portion of a conveyance route on which the recording medium wound around the winding member passes when the recording medium is supplied to the printing unit, printing, by the printing unit, to the second surface of the recording medium supplied from the second supplying unit to the printing unit after the recording medium is wound around the winding member, and notifying, in a case where the recording medium is secured to the winding member by a method other than a predetermined securing method and it is determined that the front edge of the recording medium is not secured to the winding member by the predetermined securing method, that the front edge of the recording medium is not secured to the winding member by the predetermined securing method.

27. The printing apparatus according to claim 26, wherein the performed operations further include:

detecting an edge of the recording medium set in the first supplying unit, wherein a medium winding member is set in the first supplying unit, performing control, in a case where the edge is detected, to control a position of the edge of the recording medium set in the first supplying unit such that the edge is located at a predetermined location, for guiding the edge to a predetermined opening portion of a conveyance route on which the recording medium, set in the first supplying unit, passes when the recording medium is supplied to the printing unit, by rotating the medium winding member, guiding, in a case where a recording medium has a roll shape and is set in the first supplying unit is rotated, the edge of the recording medium, set in the first supplying unit, from the predetermined location to the predetermined opening portion, and supplying, by the first supplying unit, the recording medium, having the roll shape and that is set in the first supplying unit, to the printing unit through the predetermined opening portion by rotating the recording medium, having the roll shape and is set in the first supplying unit, after the edge is controlled to be located at the predetermined location.

28. The printing apparatus according to claim 26, further comprising a conveyance unit configured to convey the recording medium, wherein the performed operations further include:

before the printing unit forms an image on the first surface, (i) supplying the recording medium from the first supplying unit and (ii) conveying the supplied recording medium by the conveyance unit such that a margin having at least a predetermined length is left between a front edge of the supplied recording medium and a front edge of an image-to-be-formed region of the first surface of the supplied recording medium, winding the recording medium around the winding member after the front edge of the recording medium that is supplied from the first supplying unit and conveyed by the conveyance unit is secured to the winding member, and supplying the recording medium wound around the winding member to the printing unit through the conveyance route, and wherein the predetermined length is a length from a position corresponding to the winding member to a position corresponding to the printing unit on the conveyance route.

29. The printing apparatus according to claim 26, wherein the performed operations further include:

supplying, by the first supplying unit, the wound recording medium to the printing unit in a case where the recording medium having the printed first surface is wound around a winding member set in the first supplying unit, and supplying, by the first supplying unit, the set recording medium to the printing unit in a case where a recording medium that is wound in advance is set to the first supplying unit by a user.

30. The printing apparatus according to claim 26, wherein the printing unit discharges ink on the recording medium for printing.

31. The printing apparatus according to claim 26, wherein the performed operations further include:

detecting an edge of the recording medium that is separated from an outer circumferential surface of a roll of the recording medium that is formed by winding the recording medium around the winding member, performing control, based on detecting the edge to control a position of the edge such that the edge is located at a specific location for guiding the edge to the opening portion of the conveyance route on which the recording medium wound around the winding member passes when the recording medium is supplied to the printing unit by rotating the winding member, wherein, in a case where the winding member is rotated, the edge is guided from the specific location to the opening portion, and supplying, by the second supplying unit, the recording medium wound around the winding member to the printing unit through the opening portion by rotating the winding member after the edge is controlled to be located at the specific location.

32. The printing apparatus according to claim 31, wherein the specific location is between the opening portion and an outer circumferential surface of a roll of the recording medium that is formed by winding the recording medium around the winding member.

33. The printing apparatus according to claim 26, wherein the performed operations further include:

supplying the wound recording medium to the printing unit by the second supplying unit in a case where the recording medium, supplied by the first supplying unit and having the printed first surface, is wound around the winding member, and supplying the set recording medium to the printing unit by the second supplying unit in a case where a recording medium that is wound in advance is set to the second supplying unit by a user.

34. The printing apparatus according to claim 26, wherein, by rotating the winding member in a first direction, the second supplying unit winds the recording medium, supplied from the first supplying unit and having the printed first surface, around the winding member, and wherein, by rotating the winding member in a second direction opposite to the first direction, the second supplying unit supplies the recording medium wound around the winding member to the printing unit through the opening portion.

* * * * *